US011615740B1

(12) United States Patent
Choi et al.

(10) Patent No.: US 11,615,740 B1
(45) Date of Patent: Mar. 28, 2023

(54) CONTENT-ADAPTIVE DUTY RATIO CONTROL

(71) Applicant: Meta Platforms Technologies, LLC, Menlo Park, CA (US)

(72) Inventors: Min Hyuk Choi, San Jose, CA (US); Cheonhong Kim, Mountain View, CA (US); Zhiming Zhuang, Sammamish, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 23 days.

(21) Appl. No.: 17/102,386

(22) Filed: Nov. 23, 2020

Related U.S. Application Data

(60) Provisional application No. 63/031,890, filed on May 29, 2020, provisional application No. 62/947,856, filed on Dec. 13, 2019.

(51) Int. Cl.

| | |
|---|---|
| ***G09G 3/3225*** | (2016.01) |
| *G09G 3/36* | (2006.01) |
| *G09G 3/34* | (2006.01) |

(52) U.S. Cl.

CPC ..... *G09G 3/3225* (2013.01); *G09G 3/3406* (2013.01); *G09G 3/3648* (2013.01); *G09G 2320/0261* (2013.01); *G09G 2320/041* (2013.01); *G09G 2320/043* (2013.01); *G09G 2320/064* (2013.01); *G09G 2320/0646* (2013.01); *G09G 2320/10* (2013.01); *G09G 2330/025* (2013.01)

(58) Field of Classification Search
None
See application file for complete search history.

(56) References Cited

U.S. PATENT DOCUMENTS

| | | | |
|---|---|---|---|
| 7,796,143 | B2 | 9/2010 | Huang |
| 8,110,997 | B2 | 2/2012 | Muramatsu |
| 8,169,387 | B2 | 5/2012 | Mittal et al. |
| 8,462,085 | B2 | 6/2013 | Inoue et al. |
| 9,070,326 | B2 | 6/2015 | Jang |
| 9,232,587 | B2 | 1/2016 | Williams et al. |
| 9,373,288 | B2 | 6/2016 | Huang et al. |
| 9,928,771 | B2 | 3/2018 | Cok |
| 10,012,375 | B1 | 7/2018 | Salessi |
| 10,242,623 | B2 | 3/2019 | Han |

(Continued)

OTHER PUBLICATIONS

Werner, Ken, "Bringing Local Dimming to Small Displays", Display Daily, Jun. 21, 2018, 5 pages.

*Primary Examiner* — Christopher J Kohlman
(74) *Attorney, Agent, or Firm* — FisherBroyles, LLP

(57) ABSTRACT

Example devices may include a display (such as an emissive display), and a controller, where the controller is configured to determine an image content parameter for a displayed image shown on the display, and adjust a duty ratio of the display based on the image content parameter. The duty ratio may be dynamically adjusted based on, for example, an image content parameter that may be related to the brightness of the image, or a portion thereof. The controller may be configured to determine an image content parameter for each of one or more portions of a displayed image, and adjust a duty ratio for corresponding parts of the display based on the image content parameter associated with the respective one or more portions of the displayed image.

18 Claims, 11 Drawing Sheets

(56) References Cited

U.S. PATENT DOCUMENTS

| | | | | |
|---|---|---|---|---|
| 10,484,577 | B1 | 11/2019 | Zhang | |
| 2005/0024320 | A1 | 2/2005 | Nowatzyk | |
| 2006/0092146 | A1 | 5/2006 | Johnson et al. | |
| 2007/0109252 | A1 | 5/2007 | Shin et al. | |
| 2007/0236447 | A1 | 10/2007 | Lee et al. | |
| 2007/0262732 | A1 | 11/2007 | Shen | |
| 2007/0262948 | A1 | 11/2007 | Han et al. | |
| 2009/0020685 | A1 | 1/2009 | Lin | |
| 2009/0322800 | A1 | 12/2009 | Atkins | |
| 2013/0082615 | A1 | 4/2013 | Williams et al. | |
| 2013/0169663 | A1* | 7/2013 | Seong | G09G 3/2044 345/589 |
| 2013/0208030 | A1 | 8/2013 | Sarrasin | |
| 2013/0271514 | A1 | 10/2013 | Ha | |
| 2014/0132650 | A1* | 5/2014 | Shin | G09G 3/342 345/694 |
| 2014/0192100 | A1 | 7/2014 | Tada | |
| 2014/0253612 | A1 | 9/2014 | Hwang et al. | |
| 2014/0362071 | A1 | 12/2014 | Jung et al. | |
| 2016/0055799 | A1 | 2/2016 | Eom et al. | |
| 2016/0351102 | A1* | 12/2016 | Shin | G09G 3/2007 |
| 2017/0287390 | A1 | 10/2017 | Lee et al. | |
| 2017/0309233 | A1 | 10/2017 | Patel et al. | |
| 2018/0089861 | A1 | 3/2018 | Klement et al. | |
| 2018/0158398 | A1 | 6/2018 | Xiang et al. | |
| 2018/0182307 | A1 | 6/2018 | Tseng et al. | |
| 2018/0267361 | A1 | 9/2018 | Richards et al. | |
| 2019/0004370 | A1 | 1/2019 | Gamperl | |
| 2019/0272788 | A1 | 9/2019 | Chen et al. | |
| 2020/0051484 | A1 | 2/2020 | Yashiki | |
| 2020/0074724 | A1 | 3/2020 | Mathur et al. | |
| 2020/0111258 | A1 | 4/2020 | Sears et al. | |
| 2021/0193067 | A1* | 6/2021 | Shao | G09G 3/3685 |

* cited by examiner

Follow 5% Duty Curve with Low Max Luminance

Follow 10% Duty Curve with High Max Luminance

CONTENT-ADAPTIVE DUTY RATIO CONTROL

CROSS REFERENCE TO RELATED APPLICATION

This application claims the benefit of U.S. Provisional Application No. 62/947,856, filed 13 Dec. 2019 and U.S. Provisional Application No. 63/031,890 filed 29 May 2020, the disclosures of each of which are incorporated, in their entirety, by this reference.

BRIEF DESCRIPTION OF THE DRAWINGS

The accompanying drawings illustrate a number of exemplary embodiments and are a part of the specification. Together with the following description, these drawings demonstrate and explain various principles of the present disclosure.

Figure 1:
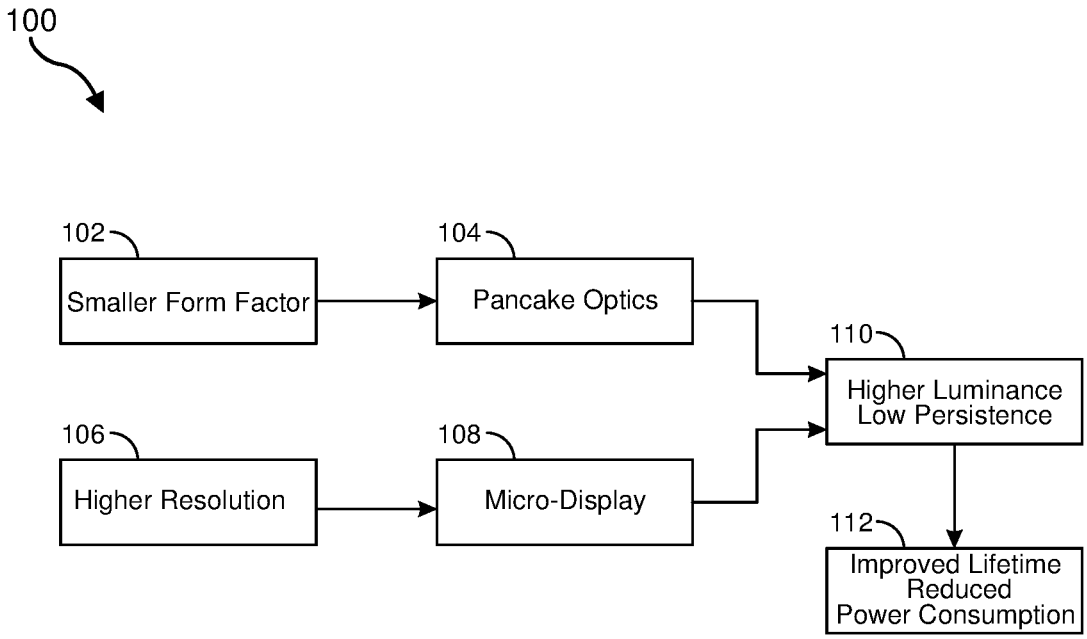
FIG. 1 illustrates possible device design aspects and possible advantages.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and are described in detail herein. However, the exemplary embodiments described herein are not intended to be limited to the particular forms disclosed. Rather, the present disclosure covers all modifications, equivalents, and alternatives falling within the scope of the detailed description and the appended claims.

DETAILED DESCRIPTION OF EXEMPLARY EMBODIMENTS

The present disclosure is generally directed to display devices, and associated systems and methods. As is explained in greater detail herein, embodiments of the present disclosure include devices, methods, systems, and the like, such as display devices, including augmented reality (AR) devices and virtual reality (VR) devices. Examples include apparatus and methods related to content-adaptive duty ratio control. Features from any of the embodiments described herein may be used in combination with one another in accordance with the general principles described herein. These and other embodiments, features, and advantages will be more fully understood upon reading the following detailed description in conjunction with the accompanying drawings and claims.

Figure 5:
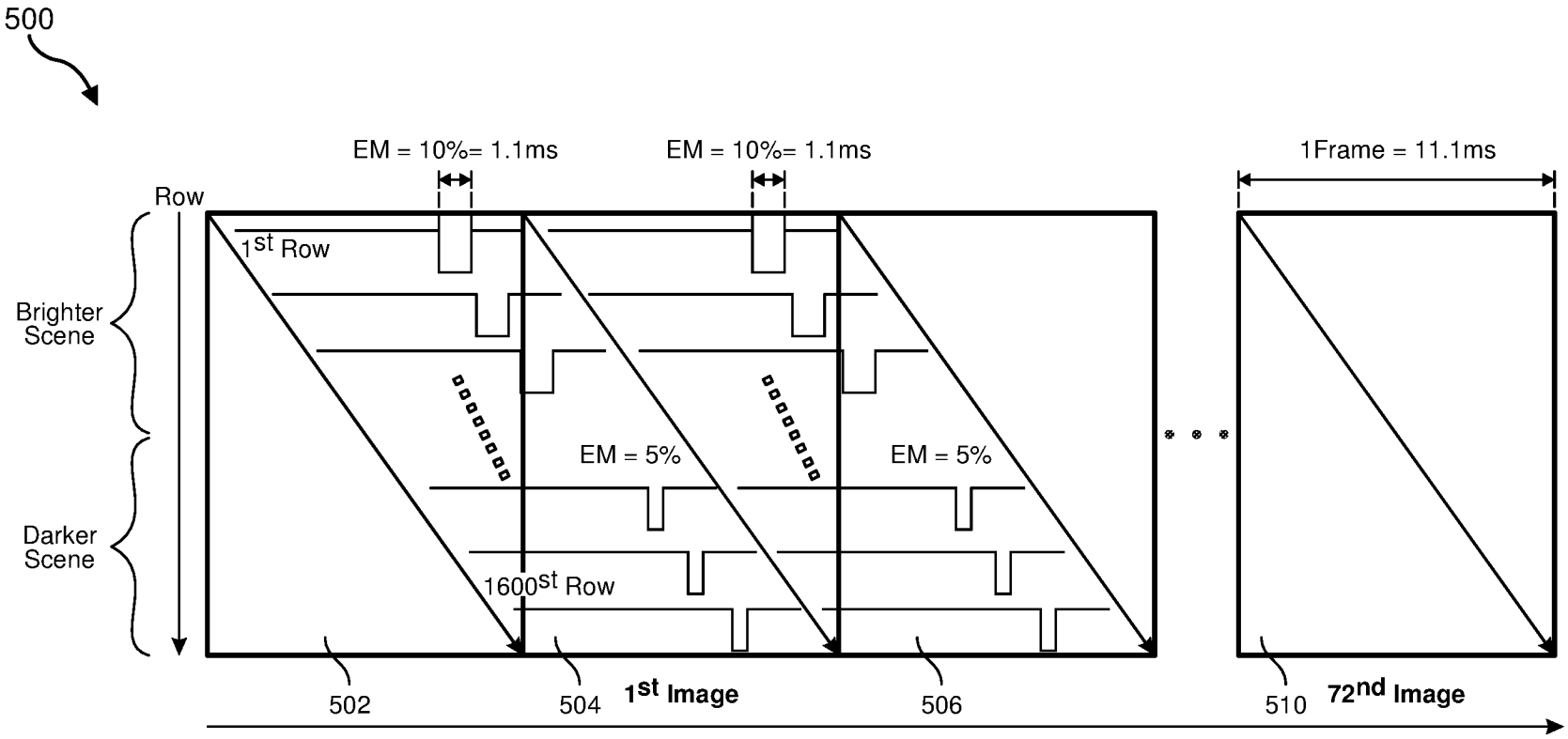
FIG. 5 illustrates a drive scheme in which the duty ratio may be dynamically adjusted based on the image row.
Figure 6A:
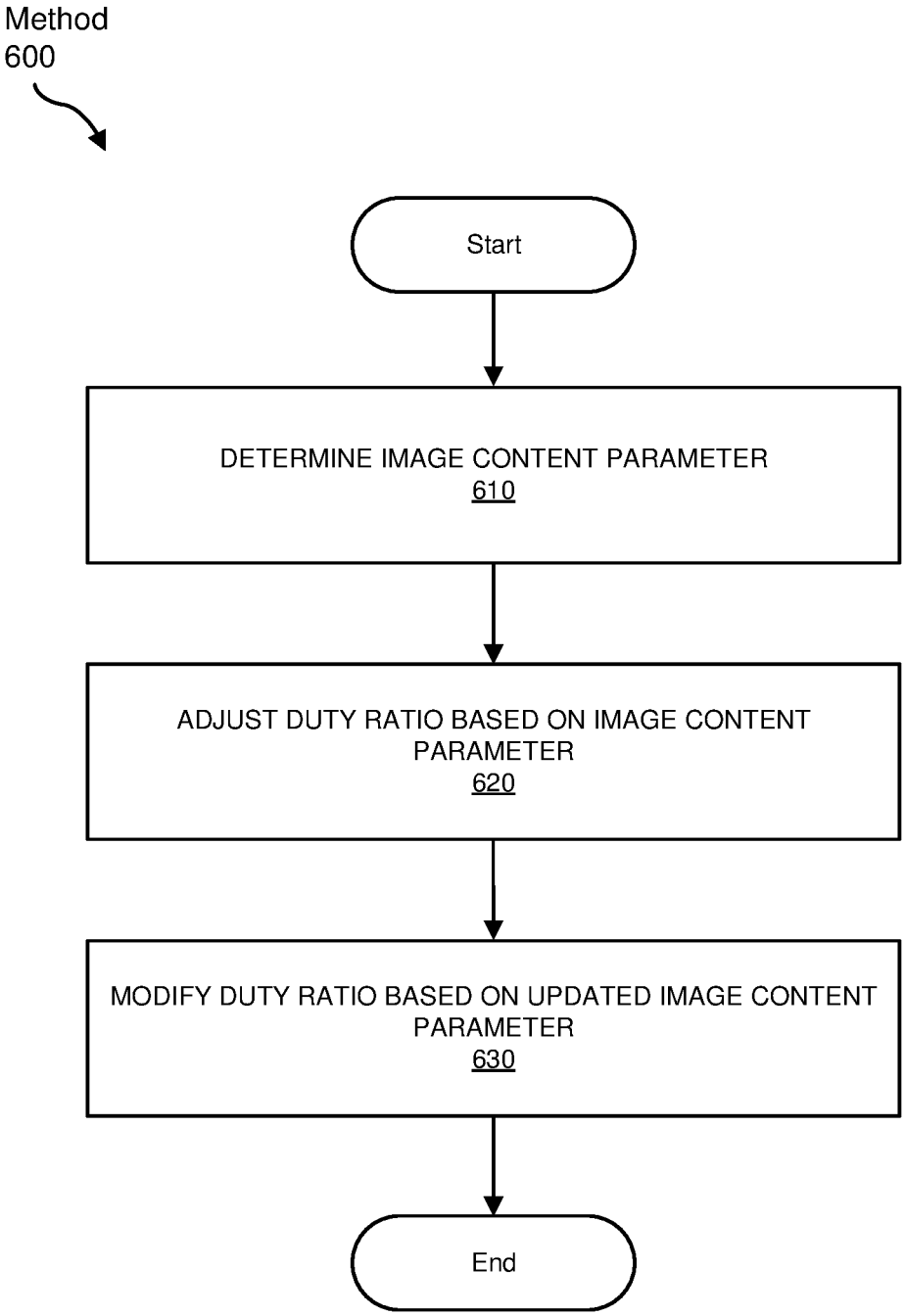
FIGS. 6A—6B illustrate example methods.
Figure 6B:
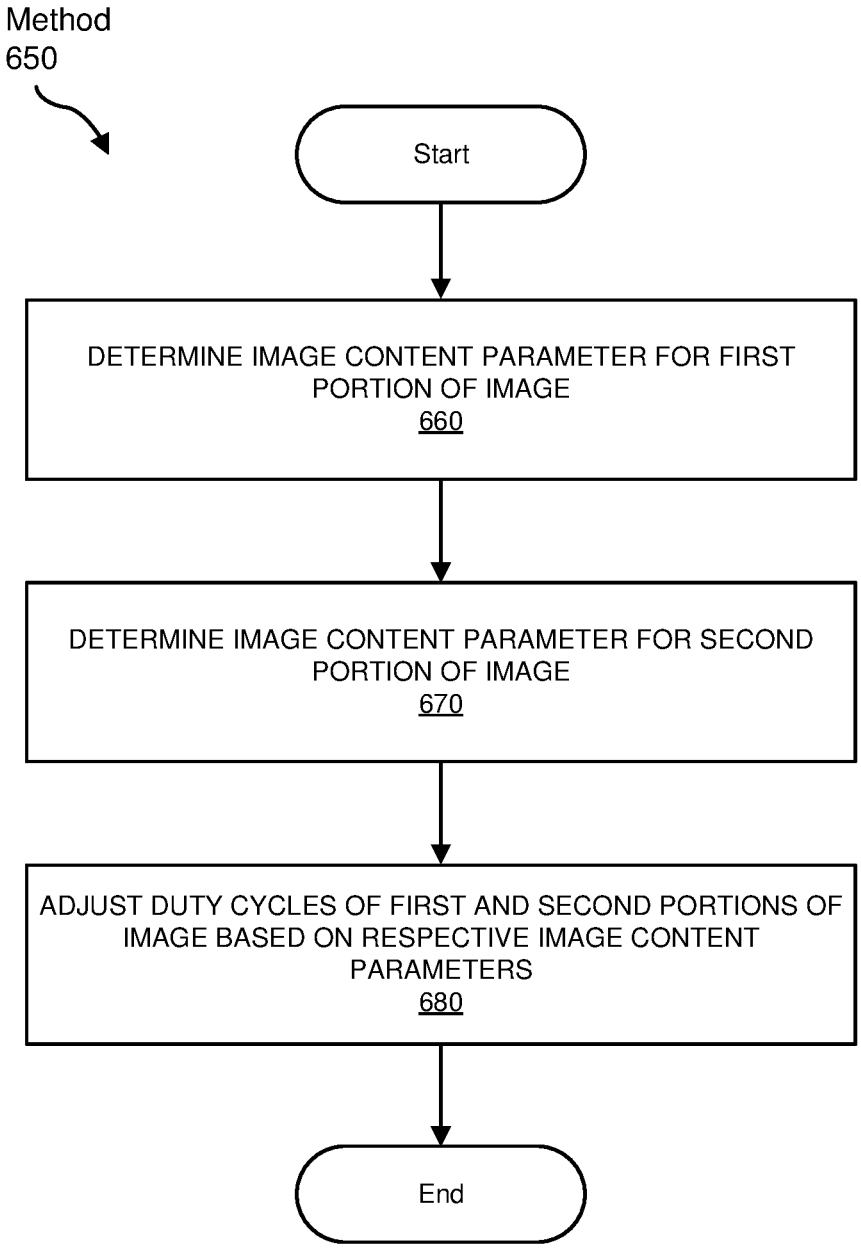
Figure 7:
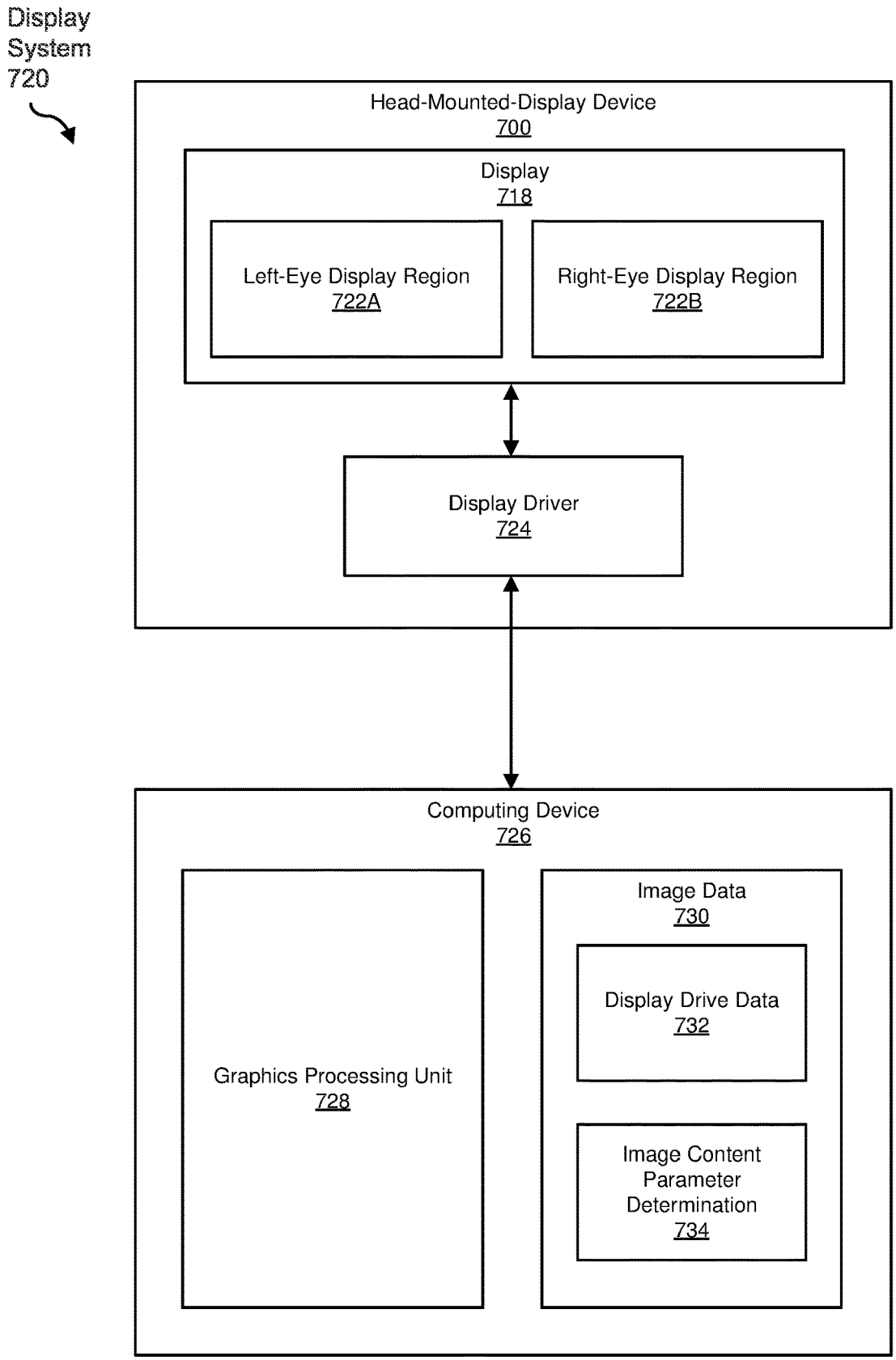
FIG. 7 shows a block diagram of an exemplary display system in accordance with some embodiments.
Figure 8:
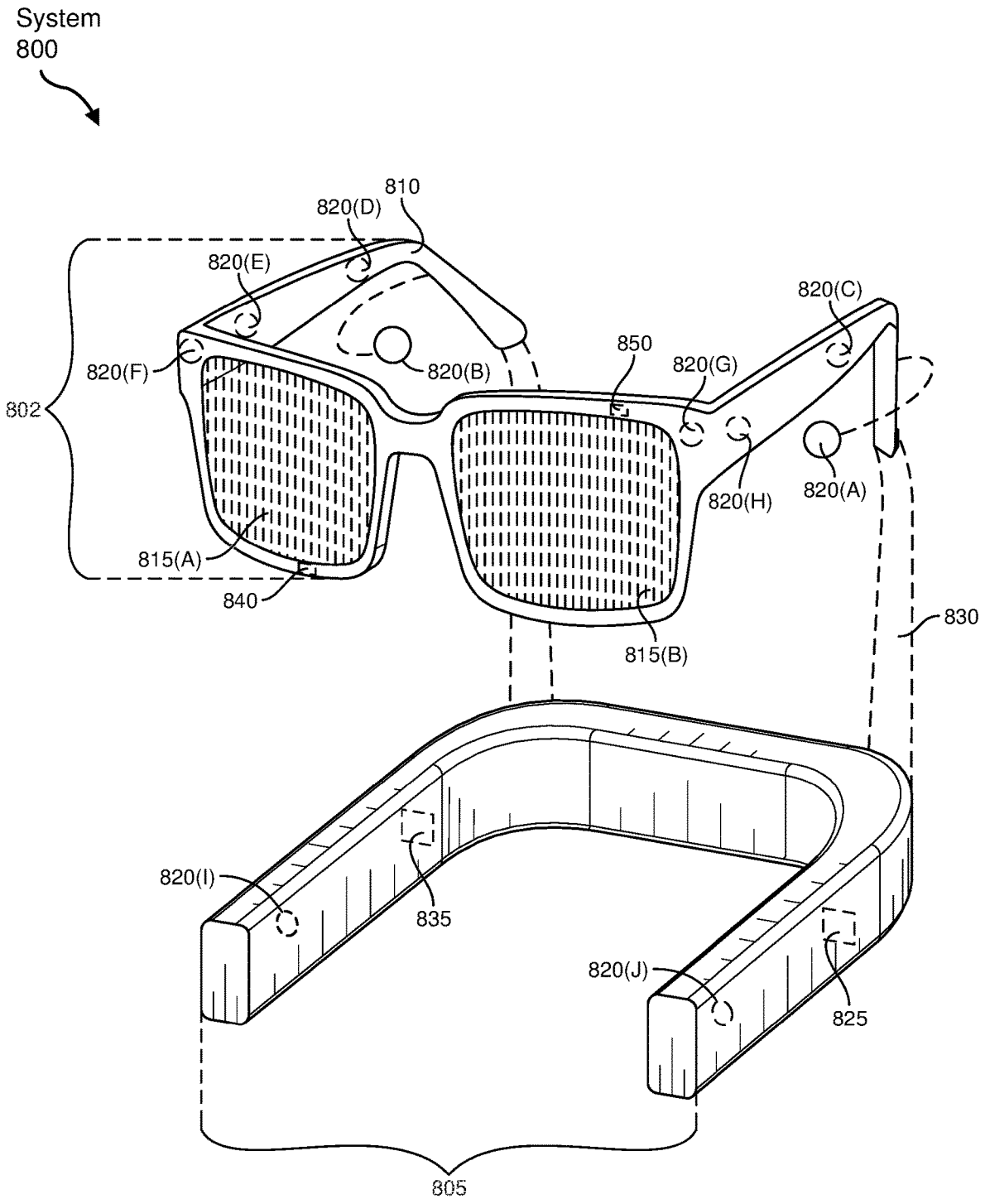
FIG. 8 is an illustration of exemplary augmented-reality glasses that may be used in connection with embodiments of this disclosure.
Figure 9:
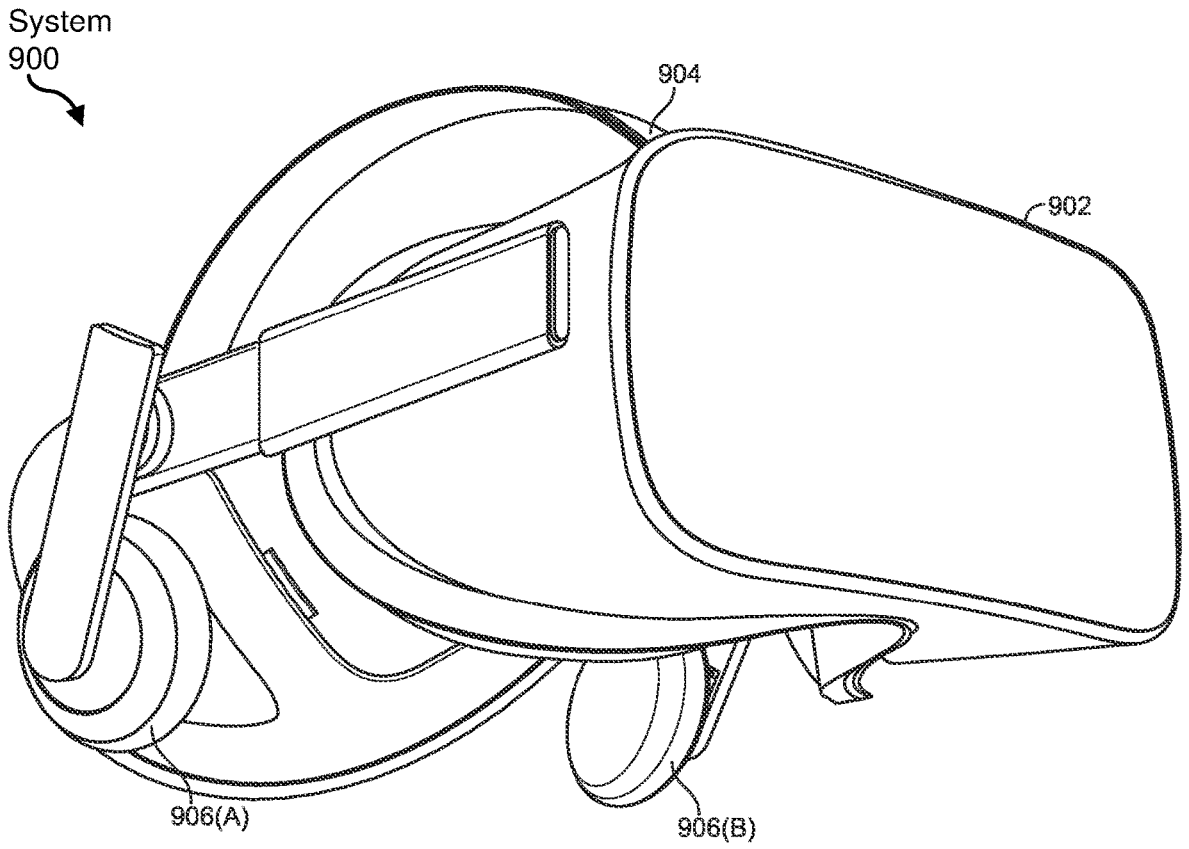
FIG. 9 is an illustration of an exemplary virtual-reality headset that may be used in connection with embodiments of this disclosure.

In some examples, a device includes a display (e.g., an emissive display including a plurality of pixels) and a controller, where the controller is configured to determine an image content parameter for a displayed image shown on the display and adjust a duty ratio of the display (or a part of the display) based on the image content parameter. The following will provide, with reference to FIGS. 1-9, detailed descriptions of various apparatus and methods, such as display devices having a duty ratio that may be adjusted as a function of spatial position on the display and/or time based on parameters related to the displayed content. FIG. 1 illustrates possible device design aspects and the corresponding description covers some possible advantages. FIGS. 2A-3C illustrate example luminance versus display drive voltage curves and example relationships between duty ratio, brightness, and drive voltages. FIGS. 4 and 5 illustrate example drive schemes having different duty ratios that may be selected or adjusted as a function of time and or display row number based on luminance and/or any other displayed image property. FIGS. 6A and 6B illustrate example methods (e.g., of display device operation), FIG. 7 illustrates example display control, and FIGS. 8 and 9 illustrate example augmented reality and/or virtual reality applications.

In some examples, a device includes a display and a controller. The device may be a near-eye device (NED), such as a virtual reality (VR), or augmented reality device. The device may include a head-mounted device, such as a helmet, visor, glasses, or any other suitable head mounted-device. In some examples, a device may be configured to provide dynamic modification of the duty ratio of the display (e.g., for a display having a persistence mode). In some examples, the display may be an emissive display, such as an LED display (e.g., an OLED display or a micro-OLED display).

The term OLED may refer to an organic light-emitting device. Example OLEDs include an OLED display (which may include an arrangement of organic light-emitting diodes), or an OLED backlight. In some examples, a liquid crystal display (LCD) may include an OLED backlight.

The duty ratio may be the percentage of time that a pixel is illuminated for a given frame. For example, a duty ratio of 10% may refer to pixels that are illuminated for 10% of the frame time. Reducing the duty ratio may allow visually perceived motion blur to be reduced, sometimes approximately proportionally. The term "duty-cycle" may sometimes be used instead of duty ratio and may have a similar meaning. In some examples, a display or portion thereof may have a dynamically adjustable content-dependent duty ratio. In some examples, the term "dynamically adjustable" may refer to a duty ratio that may be modified by a control circuit and may be, for example, based on the image properties. In some examples, the term "content-dependent" may refer to the values of one or more image content parameters, such as maximum luminance.

In some examples, a display may be an emissive display and may include emissive pixels. The duty ratio of an emissive pixel may relate to the percentage of time that the pixel is illuminated for a given time period, which may be a frame time, row time, or other defined time (such as an integer multiple of a frame time or row time). In some examples, an image may be displayed with a duty ratio that is the same for the entire image. In some examples, an image may be displayed with a duty ratio that may be different for different portions of the image, such as image portions having one or more different image content parameters. The image content parameter may be based on the brightness of the image or portion of an image. In some examples, the duty ratio may have a spatial variation over the display based on image content parameter variations, such as luminance variations as a function of position (e.g., row number) within the image. The duty ratio used to display an image (or a portion of the image) may have a temporal variation based on variations in the image content parameter for the image (or the portion of the image). In some examples, portions of the image may be defined by grouping together rows having similar image content parameters, and the extent of an image portion may vary with time as the image content varies. In some examples, an image portion may be a contiguous portion (e.g., including adjacent rows). In some examples, an image may include a non-contiguous portion (e.g., including areas of similar image content parameter distributed through the image).

In some examples, the duty ratio may be dynamically controllable based on one or more image content parameters. An image content parameter may include the maximum luminance, minimum luminance, or average luminance of a displayed image or a portion of the displayed image. The duty ratio may be adjusted based on the content of an image, and the content may be characterized by one or more image content parameters. In some examples, the duty ratio may be based on the luminance properties of an image or a portion of the image.

In some examples, the duty ratio of a display may be adjusted such that a first portion of the image is displayed using a different duty ratio than a second portion of the image. The duty ratio used by the display may have a spatial variation over the image, and the spatial variation of the duty ratio may be based on the spatial variation of one or more image content parameters, such as brightness or luminance. Luminance may be considered as the intensity per unit area along a particular direction from the display, such as along a viewing direction (if known), an estimated viewing direction, or a predetermined direction, such as along a direction normal to the display emissive surface. In some examples, the term "brightness" may be used to refer to luminance and/or to a qualitative (e.g., user-perceived) light intensity of the display. In some examples, the terms brightness and/or luminance may be used to refer to a parameter based at least in part on the light output of the pixel, such as emitted light energy. In some examples, the brightness of display may include subjective factors related to the viewer, such as the eye's luminosity function (e.g., photopic response), the ambient illumination level, spectral response of eyewear or other optical element between the display and the eye of the user, spectral properties of the displayed image or portions thereof, or one or more other parameters. The luminosity function (e.g., photopic response) may be estimated for a typical user, and in some examples an estimate of the user's photopic response may be improved using demographic, calibration, and/or physiological data collected from the user. The terms brightness, intensity, or luminance may be used in the various described examples, and examples may also include examples related to use one or more of the other terms, including determination of the display intensity, luminance, and/or brightness, and modification of the duty ratio based on one or more of such measurements. For example, the duty ratio of a display portion may be based on (e.g., correlated with) the luminance properties (e.g., the maximum luminance) of the image portion corresponding to the portion of the displayed image. In some examples, a relative change in duty ratio may be based on (e.g., approximately proportional to) a corresponding relative change in intensity, luminance, and/or brightness.

In some examples, the brightness of a display (e.g., the luminance as a function of position on the display) may be determined using one or more light sensors, such as an image sensor. In some examples, the brightness of a display may be determined from the electronic drive signal provided to the display, which, for example, may encode a desired spatial variation in brightness. In some examples, the brightness of the display (e.g., as determined from the drive signal) may be determined including one or more other parameters, such as a backlight intensity, a user-controllable brightness setting, or other parameter. For example, the display drive signal may encode spatial variations in relative brightness, and this may be scaled by one or more overall brightness control parameters.

In some examples, the duty ratio may be determined based on the content of a series of images, such a portion of a video, and may be determined by the content of a video over a particular time window. For example, one or more image content parameters may be determined on a frame-by-frame basis, as a running average, or as an average of a particular number frames over a time interval. The duty ratio may be determined based on the content of one or more video frames, may be determined based on the content of a single frame, or may be determined based on the content of a sub-frame (e.g., may be based on the content of a portion of a displayed image, such as one or more rows of the displayed image). In some examples, such as for recorded video or dynamically generated video content, image content parameters may be known in advance of image display, and the duty ratio may be determined based on an average over past, present, and/or future frames. In relation to a display pixel, the term "persistence" or "persistence time" may also be used to refer to the visibility time, or illumination time, of the pixel. The persistence time may be related to the product of the frame time and the duty ratio. For example, if the frame time is 10 ms and the duty ratio is 10% then the persistence time may be 1 ms. The duty ratio may be reduced by reducing the persistence time of a pixel (for a given frame time) and/or by introducing "black frames," which may include frames in which the pixel may not be illuminated at all. In some examples, a duty ratio may be reduced from an initial percentage to a (lower) final percentage by reducing the persistence time of the pixel, by introducing black frames, or some combination thereof. A duty ratio may be increased by increasing the persistence time or by removal of black frames (if any).

A viewer of a display may perceive motion blur at higher duty ratios. Perceived motion blur may be reduced using a lower duty ratio, but this may also reduce the luminance of the display. For an organic light-emitting device (OLED), one approach to maintaining display luminance while reducing duty ratio is to increase the drive voltage. However, this may reduce the display lifetime and may also require increased power.

In some examples, the duty ratio may be reduced for a low luminance image. A low luminance image may be an image with a relatively low value of an image content parameter, such as one or more of the following: maximum brightness (e.g., luminance), average brightness (e.g., luminance), or a predetermined percentile brightness (e.g., luminance). In some examples, the duty ratio may vary across an image and may be, for example, based on a corresponding variation in an image content parameter. In some examples, the duty ratio may vary as a function of row number and may be, for example, based on an image content parameter of the corresponding row (or group of rows). In some examples, an image content parameter may include at least one of maximum luminance, mean luminance, median luminance, a predetermined percentile of maximum luminance, minimum luminance, or a mean of minimum luminance and maximum luminance. In some examples, a histogram analysis may be used to determined one or more of such parameters.

The duty ratio may be dynamically adjusted based on a temporal and/or spatial variation in an image content parameter, such as maximum luminance or at least one other luminance-related parameter.

A display (such as an OLED display) with content-adaptive duty ratio control may have one or more of the following advantages: reduced persistence, particularly for a high resolution display; improved display lifetime, for example, by allowing drive voltage reduction in some cases; and/or reduced power consumption. System latency for content analysis may be reduced through slice/row implementation.

In some examples, a device may include one or more sensors, such as photodiodes, configured to monitor the light intensity (e.g., luminance or brightness) of a virtual reality (VR) display, augmented reality (AR) display, or of any other suitable display. The sensor signal may be used to determine, verify, and/or calibrate image content parameters. For example, algorithmically-determined image content parameters may be compared against a light intensity measurement (e.g., a brightness measurement), and algorithms may be adjusted or calibrated as a result.

FIG. 1 shows possible approaches to device design, for example, related to near-eye display applications such as augmented reality (AR) or virtual reality (VR). The graphical representation 100 illustrates that the use of a relatively compact form factor (102), pancake optics (104), higher resolution (106), and use of a micro-display (108), in combination with higher luminance and lower persistence (110), enables improved lifetime (e.g., longer operational lifetime of an OLED) and reduced power consumption (112). Example devices may advantageously have a reduced form factor (e.g., reduced size and/or weight, for improved convenience and/or comfort) relative to traditional AR displays systems. Form factor may be reduced using pancake lenses or other approaches to folded beam paths.

Voltage-luminance curves for example OLEDs generally show the luminance increasing for higher voltages. In some examples, a higher display luminance may be obtained by increasing the duty ratio, for images (or portions of images) having relatively bright content, which allows voltages to remain at relatively low values (e.g., compared to obtaining a higher luminance using a higher voltage and not changing the duty ratio). A higher display luminance may be obtained using a higher duty ratio, rather than increasing the drive voltages. Further examples are discussed below.

A reduced duty ratio corresponds to a lower display persistence, and this may reduce motion blur and may reduce the display brightness. If the duty ratio is fixed at a high value, the display brightness may not be an issue, but motion blur may be unacceptable. If the duty ratio is fixed at a low value, motion blur may not be an issue but high drive currents may be required for brighter displayed content. These high drive currents may lead to problems with one or more of heat generation, device inefficiency, power consumption, and relatively rapid device degradation. A dynamically adjustable content-dependent duty ratio allows, for example, the duty ratio to be reduced for lower brightness images, and to be increased for higher brightness images. This approach may improve display lifetimes (e.g., OLED display lifetimes) by avoiding high drive currents, and may reduce power consumption due to more efficient device (e.g., OLED) operation. Avoiding high drive currents may also avoid spikes in heat generation in one or both of the display and the controller.

Figure 2A:
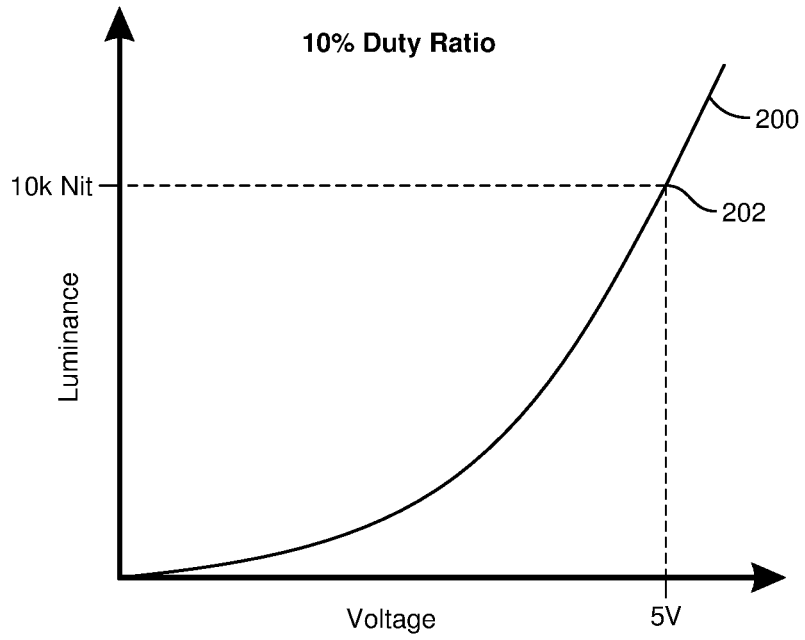
FIGS. 2A and 2B show luminance versus display drive voltage curves for 10% and 5% duty ratios, respectively.
Figure 2B:
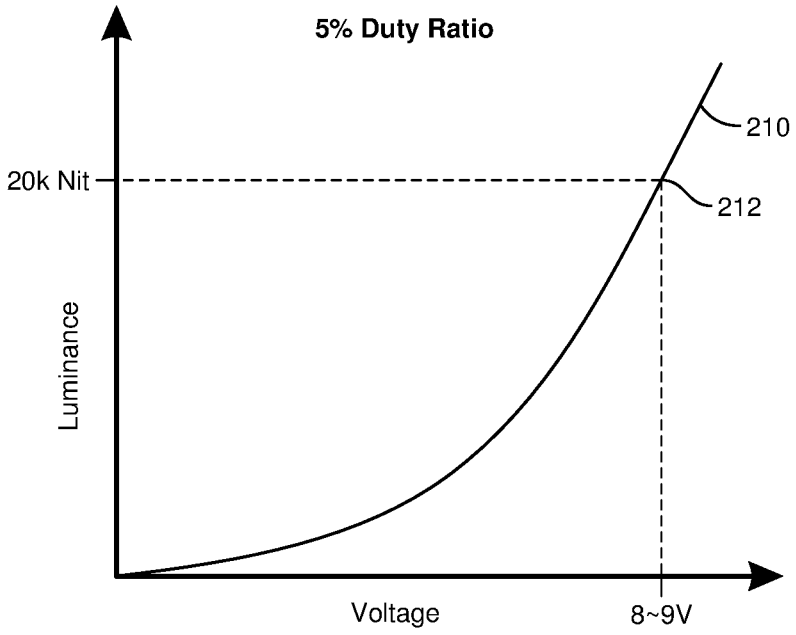

FIGS. 2A and 2B show example voltage requirements for a given luminance for 10% and 5% duty ratios, respectively. FIGS. 2A and 2B show luminance (in kilonits) versus voltage for different duty ratios. A nit (nt) may be, in some examples, one candela per square meter along a particular direction. FIG. 2A shows the relationship 200 between voltage and luminance for a duty ratio of 10%, indicating that a duty ratio of 10% allows a brightness of 10 knits to be obtained using 5V (shown at 202). FIG. 2B shows the relationship 210 between voltage and luminance for a duty ratio of 5%, indicating that a duty ratio of 5% allows a brightness of 20 knits to be obtained at approximately 8-9 V (shown at 212). However, higher voltages may degrade the display relatively rapidly, as device degradation may be disproportionally accelerated by high drive voltages and/or drive currents. Device efficiency may also fall for high drive voltages and/or drive currents.

For higher resolution, low persistence may be needed, and this may be achieved using low duty ratios. However, driving the display using a fixed low duty ratio may require the use of higher voltages to display bright scenes (which may also be referred to as relatively high luminance images). However, higher voltages may lead to more rapid degradation of the display.

In some examples, the duty ratio may be dynamically adjusted based on the image content (e.g., based on an image content parameter). The image content parameter may be based the brightness or luminance of an image, or a portion of an image. For example, the duty ratio may be increased for brighter scenes, allowing higher luminance to be achieved with lower voltages (e.g., compared with the voltage required to obtain a higher luminance using a lower duty ratio). This may allow reduction (or at least avoid an increase) of the drive voltage, while allowing relatively bright scenes to be shown without use of higher drive voltages. A lower duty ratio may be used for relatively low brightness scenes, which may allow reduced power consumption and/or improved display lifetime, and may provide greater immersivity for virtual reality applications by reducing motion blur in action scenes. In some examples, a lower duty ratio may be used for all but the brightest scenes.

Figure 3A:
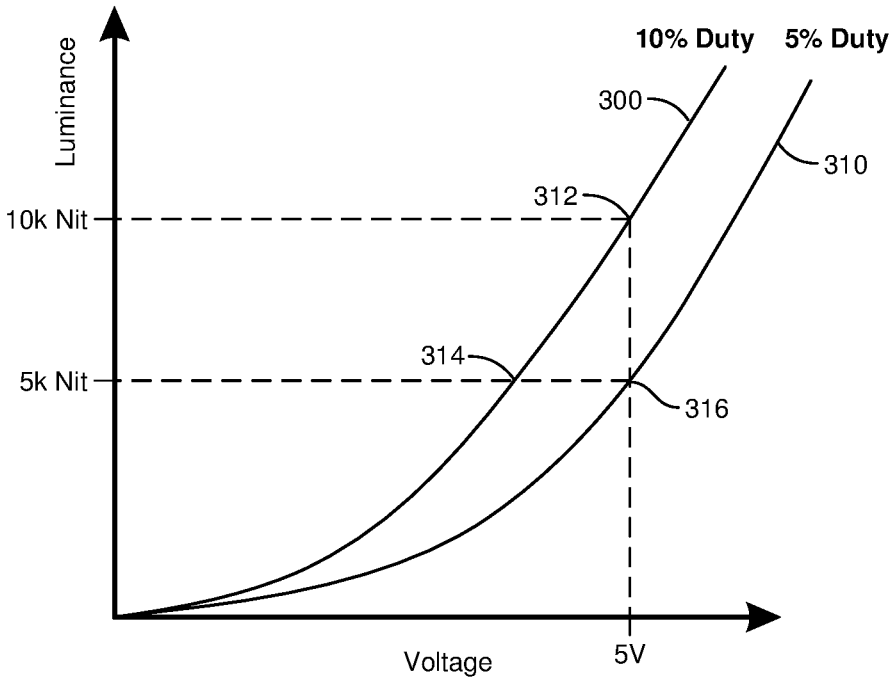
FIG. 3A shows the luminance-voltage curves for the two duty ratios.

FIG. 3A shows the luminance-voltage relationships 300 and 310 for the two duty ratios (10% and 5%, respectively) on the same graph. These exemplary data are qualitative and illustrative. The graph shows that a higher duty ratio allows a lower drive voltage to be used for a given luminance. For example, a using a duty ratio of 5% may require a drive voltage of approximately 5V to achieve a luminance of 5 k nit (illustrated at 316), but a lower drive voltage may be used if the duty ratio is increased to 10% (illustrated at 314). Similarly, the luminance may be appreciably increased for the same drive voltage by increasing the duty ratio (illustrated at 312). Using a lower drive voltage for a given display brightness may reduce power consumption, extend display life, and/or reduce heat dissipation. Using a lower duty ratio may reduce motion blur and improve the immersive experience of virtual reality and/or augmented reality experienced when using the display.

In some examples, reducing both the duty ratio and the drive voltage may limit the maximum available brightness of the display. Hence, it may be advantageous to dynamically adjust the duty ratio based on the brightness of a displayed scene, for example, by reducing the duty ratio for a lower brightness scene.

Figure 3B:
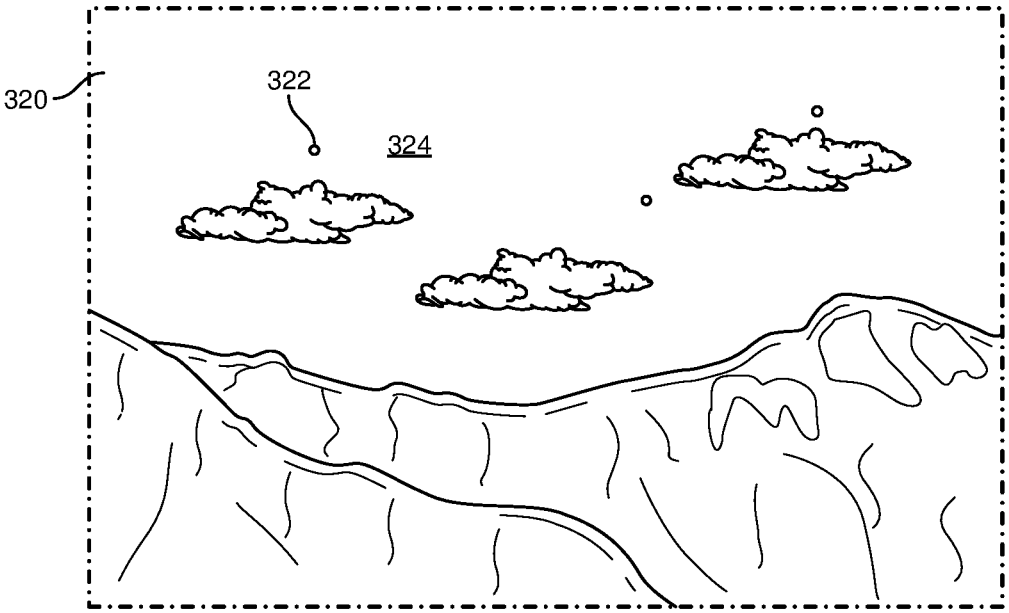
FIG. 3B illustrates a representative darker image.

FIG. 3B illustrates a representative darker image of a nighttime scene 320 having a relatively low maximum luminance. There may be stars 322 visible in a night-time sky 324. The maximum image brightness may be relatively low. The duty ratio of the display may be reduced while displaying a darker (or relatively low brightness) scene. For example, the duty ratio may be a lower value, such as approximately 5%, for relatively low brightness scenes, and may be increased to a higher value, such as approximately 10%, for higher brightness scenes.

Figure 3C:
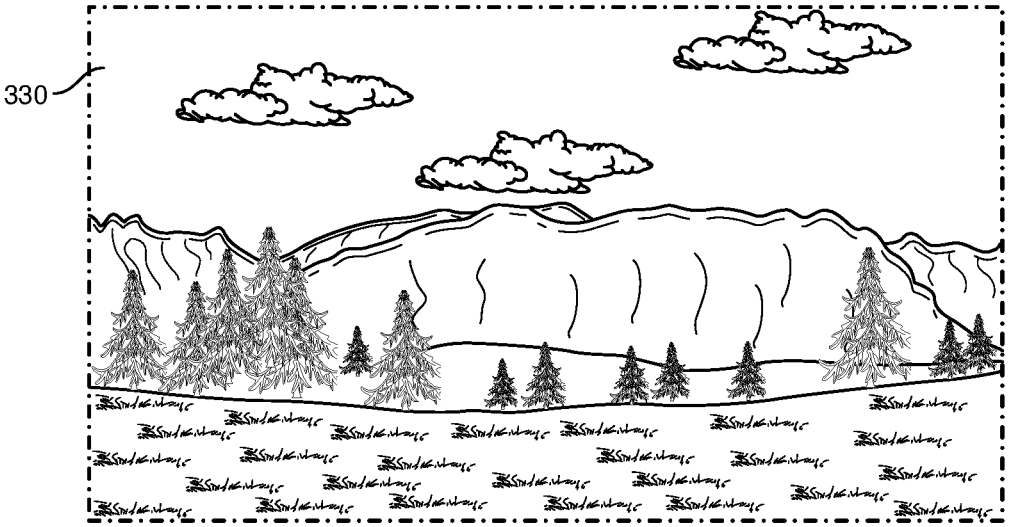
FIG. 3C illustrates a representative brighter image.

FIG. 3C illustrates a representative bright image 330 of a sunny daytime scene having a relatively high maximum luminance. The duty ratio of the display may be increased while displaying this image, relative to the display of dark scenes. For example, the duty ratio may be a relatively high value, such as 10%. This adjustment allows a bright scene to be displayed, in some examples, without using the higher voltages that may be needed using a lower duty ratio.

In some examples, an image may be displayed by an electronic display using a first duty ratio for a first value of an image content parameter (such as brightness), and using a second duty ratio for a second value of the image content parameter. For example, a higher duty ratio may be used to display a relatively brighter image, or portion thereof, and the duty ratio may be dynamically adjusted by a controller based on time-dependent variations in the image content parameter (such as brightness). In some examples, a controller may be configured to dynamically adjust duty ratio values and/or spatial variations in the duty ratio based on corresponding time-dependent and image portion dependent variations of the image content parameter.

In some examples, the duty ratio may be dynamically adjusted for a portion of a displayed image, and there may be a spatial variation of the duty ratio over the displayed image, for example, by adjusting the duty ratio for a portion of an image based on the brightness of the corresponding portion of the image.

An improved method of displaying an image, using an electronic display such as an OLED, may include determining an image content parameter (such as the maximum image brightness) and adjusting the duty ratio of at least a portion of the display in response to the image content parameter determination (e.g., the maximum brightness determination). For example, if the maximum available display brightness for a lower duty ratio is greater than the maximum image brightness, the lower duty ratio may be used. In some examples, the display may be divided into portions, and the duty ratio of each display portion may be adjusted independently of each other based on the maximum image brightness of the image portion corresponding to each display portion. Display portions may be predetermined or dynamically selected based on image characteristics. For example, a display portion selected for dynamic duty ratio adjustment may be defined based on image characteristics by dividing an image into one or more image portions based on brightness and then controlling the duty ratio of the corresponding display (or image) portions.

In some examples, a display (or a portion of a display) may have two or more operational modes, each operational mode having a different duty ratio, and an operational mode may be selected based on maximum image brightness or other image content parameter. In some examples, the duty ratio may be adjusted continuously based on one or more image content parameters.

In some examples, the display drive voltage may be adjusted based on the maximum image brightness or other image content parameter. In some examples, the drive voltage may be adjusted along with adjustments of the duty ratio. In some examples, the duty ratio may be adjusted within a predetermined range, and the voltage may be increased if necessary to achieve a higher display brightness, reduced motion blur, and/or for fast image movements.

As noted, a display may be configured so that the duty ratio may be adjusted based on an image content parameter. The image content parameter may be maximum image brightness, as discussed in examples above, but this and other examples are not limiting. For example, a proportion of brightest image pixels may be disregarded so that less than a predetermined number of pixels brighter than a threshold brightness may not cause the duty ratio to be adjusted. In some examples, the image content parameter may be a percentile of pixel brightness (e.g., a percentile of the pixel light intensity), such as the brightness of the 95th percentile of all pixel brightnesses, other percentile brightness value (such as 90th, 85th, 80th, intermediate percentile, or any other suitable percentile), or any other suitable measure. In some examples, duty ratio may be adjusted based on an average image brightness, such as mean or median brightness. In some examples, pixel brightness may relate to the emitted light intensity from one or more pixel, the luminance of one or pixel along a particular direction, or other suitable parameter. The display may be divided into portions, based on location and/or image content values, and the duty ratio may take different values within one or more portions, based on different values of the image content parameter.

In some examples, the duty ratio may be selected from a plurality of discrete values, such as a higher value or a lower value. In some examples, the duty ratio may be adjusted in a continuous or near-continuous manner, optionally between lower and higher limits. For example, the duty ratio may be dynamically adjusted based on an image content parameter, such as highest luminance. This approach may allow, on average, an improvement in the visual perception of the display, where the improvement (e.g., reduced motion blur) may be greater in relatively low brightness scenes).

Figure 4A:
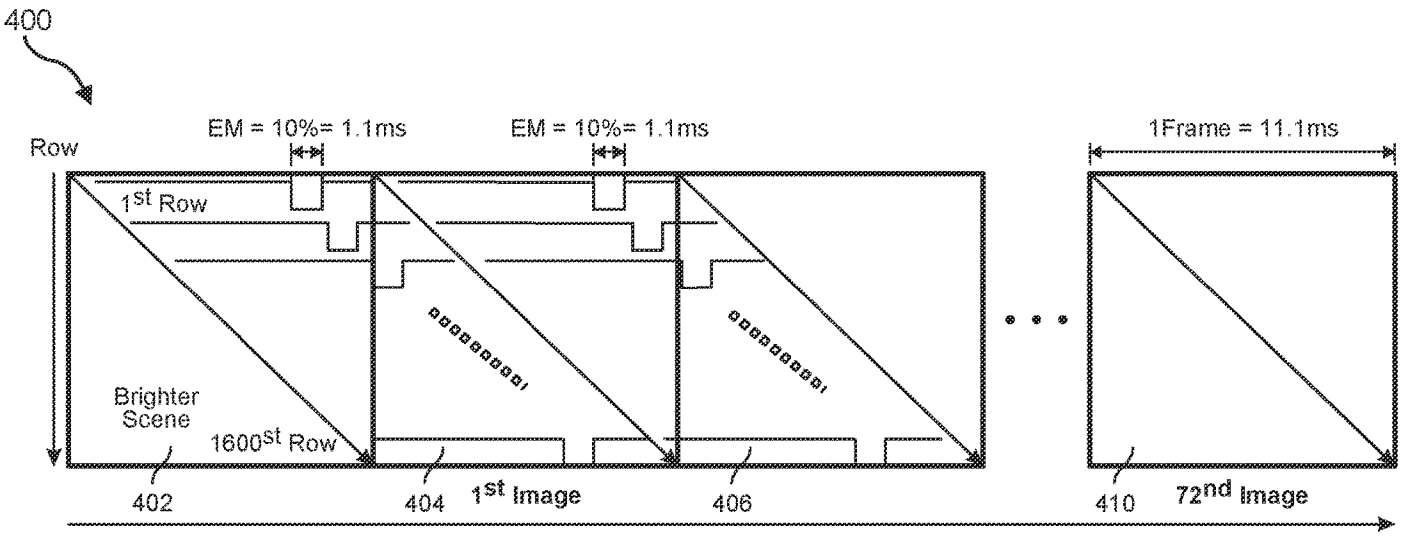
FIGS. 4A and 4B illustrate example drive schemes having different duty ratios, that may be selected or adjusted based on image luminance.
Figure 4B:
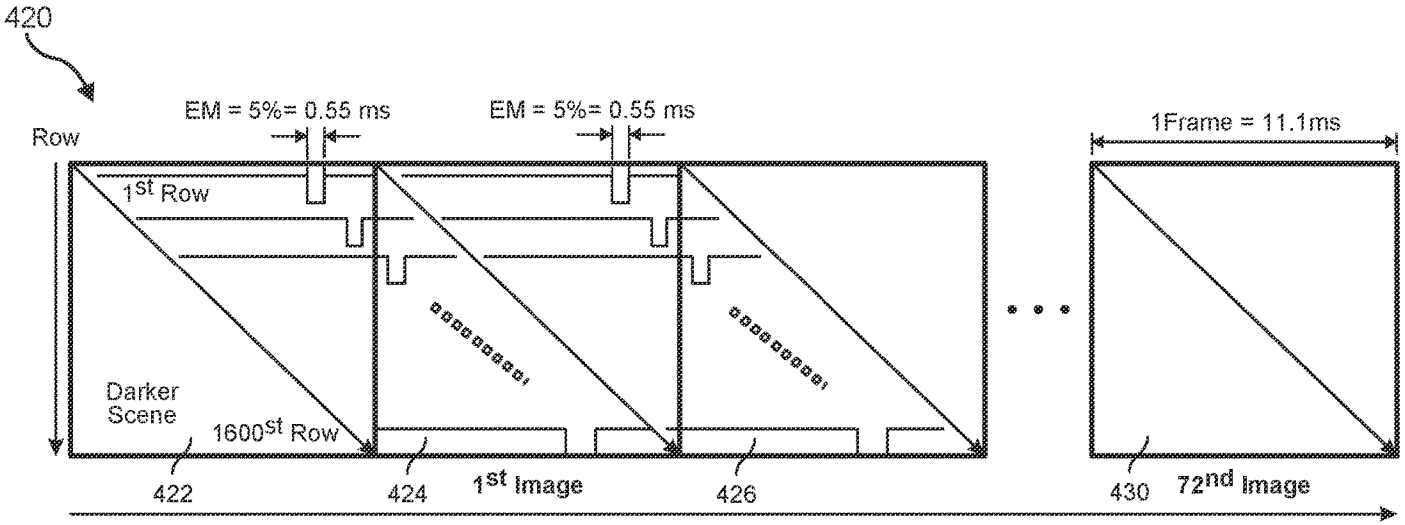

FIGS. 4A-4B illustrate example drive schemes having different duty ratios, that may be selected or adjusted based on image luminance. FIG. 4A shows a relatively brighter scene displayed using a higher duty ratio (10%), showing representative images (e.g., frames) generally at 400, including images 402, 404, 406, and 410. The duty ratio may be related to the ratio of the illumination pulse length to the frame time. In this example, the illumination time is 1.1 ms, the frame time is 11.1 ms, and the duty ratio is 10%. FIG. 4B shows how relatively darker scene may be displayed using a lower duty ratio, showing representative images 422, 424, 426, and 430, generally at 400. If the frame time remains the same, the duty ratio may be adjusted by modifying the illumination time of the display (or portion thereof) during a frame time. In this example, the illumination time is 0.55 ms, the frame time is 11.1 ms, and the duty ratio is 5%. Images may be shown successively (e.g., one after another) on a display, for example, to show a video. An image may include a frame from a video signal.

The duty ratio may be adjusted for an entire image frame or for one or more rows of an image frame. The duty ratio may be dynamically adjusted based on an image content parameter (such as maximum or average luminance, or other luminance or brightness based parameter), for example, for an image frame or a portion thereof, such as one or more image rows. In some examples, a duty ratio adjustment may be performed by hardware specifically configured to perform the adjustment, such as a DDIC (display driver integrated circuit), which may also be termed a display driver. A DDIC or other component of a controller may be configured to perform an analysis (e.g., a histogram analysis) of the display drive signal to determine an image content parameter, modify the duty ratio in response to the image content parameter, and in some examples modify the gamma curve used for the display based on the duty ratio. For example, a DDIC may store different gamma curves associated with different values of duty ratio.

FIG. 5 illustrates dynamic adjustment of the duty ratio, for example, during a single frame time. FIG. 5 shows a representation of a series of image frames 500, including representative image frames 502, 504, 506, and 510. Image frames 500 may be presented on a display. The figure illustrates that duty ratio may be adjusted on a row-by-row basis. For example, rows in a first portion of the image (e.g., an upper portion) may have a higher duty ratio, for example, corresponding to the display of brighter image content (indicated as a brighter scene in the figure). Rows in a second portion of the image (e.g., a lower portion) may have a lower duty ratio, for example, corresponding to the display of relatively lower brightness image content (indicated as a darker scene in the figure). For example, for each row, the display may be illuminated for a fraction of the frame time, and the fraction may be termed the duty ratio. In this example, for representative image frame 504, the duty ratio may be 10% for an upper portion of the image (as illustrated), and 5% for a lower portion of the image. The duty ratio for a first portion of an image may be higher than a duty ratio for a second portion of the image, if the first portion of the image is brighter than the second portion. The first portion may include one or more rows of the image, and the second portion may include one or more different rows of the image.

Similarly, for representative image frames such as 502, 506, and 510, the duty ratio may be a first value (e.g., 10%) for a first plurality of rows, and may be a second value (e.g., a duty ratio lower than the first value, such as 5%) for a second plurality of rows. Other values and/or distributions of duty ratios may be used. The value of duty ratio may have a spatial distribution, such as a row-by-row distribution, which may be based on an image content parameter (such as brightness) for respective rows. For similar portions of an image, the duty ratio may be adjusted on a frame-by-frame basis. The values and/or spatial distributions (e.g., row-dependent distribution) of duty ratios for a displayed image may also be adjusted between different image frames, for example, based on the time dependence of an image content parameter for respective image portions (e.g., row brightnesses) of a displayed image.

In some embodiments, the duty ratio may be dynamically adjusted for different portions of an image display. For example, different rows of a display may show an image portion using different duty ratios (e.g., duty ratios based on an image content parameter associated with a row or group of rows and/or corresponding image portion). In such embodiments, if the upper portion of an image has a brighter luminance than the lower portion (e.g., due to a bright sky in an outdoor image), the upper portion of the image may be displayed using a first duty ratio, and the lower portion of the image may be displayed using a second duty ratio. The first duty ratio (e.g., for the brighter portion of the image) may be greater than the second duty ratio (e.g., for a lower brightness portion of the image). In some examples, the first duty ratio may be 50%, 100%, 150%, 200%, 300%, 400%, or any other proportion greater than the second duty ratio. In some examples, the duty ratio may vary as a function of row number, or a function of row groups, for example, based on an image content parameter for each respective row or group of rows.

In some examples, approaches to adjusting duty ratio may be used to adjust the brightness of a backlight, or a portion of the backlight. In some examples, a backlight may include an OLED display, which may include an arrangement of color and/or white light emissive elements. The OLED display may provide a backlight for an associated liquid crystal display (LCD), and may be referred to as an OLED backlight. The OLED backlight may include emissive elements that may be illuminated with a duty ratio based on an image content parameter of a corresponding portion of displayed image. The image may be displayed using a combination of the LCD and the OLED backlight. For a brighter portion of the image, a corresponding part of the OLED backlight may be illuminated with a higher duty ratio. For a less bright portion of the image, the duty ratio of the corresponding part of the OLED backlight may be lower. The approaches described above in relation to FIG. 4 and FIG. 5 may be readily adapted to the driving of an OLED backlight. One or more rows (or other arrangement) of emissive elements within the OLED backlight may be driven with a duty ratio that is based on an image content parameter for an image portion displayed on a corresponding part of the LCD. In this context, the corresponding part of the LCD may include a part of the LCD through which light from the backlight passes to form the image portion, and the corresponding part of the OLED backlight may provide the light that passes through the corresponding part of the LCD to form the image portion.

In some examples, a method includes determining an image content parameter for at least a portion of an image and displaying the at least a portion of the image on an electronic display using a first duty ratio that is based on the image content parameter. The image content parameter may be based on at least one luminance parameter, such as maximum luminance, mean luminance, median luminance, a predetermined percentile of any other luminance parameter such as maximum luminance, or minimum luminance. The method may further include displaying a subsequent frame of the image using a subsequent duty ratio, where the subsequent duty ratio is different from the first duty ratio. The method may further include displaying a second portion of the image using a second duty ratio, where the second duty ratio is different from the first duty ratio. The duty ratio may vary with one or both of time or spatial position on the display.

FIG. 6A is a flow diagram of a computer-implemented method 600 for adjusting the duty ratio based on image content, according to some embodiments. The computer-implemented method 600 may include determining a first image content parameter for a displayed image (610), adjusting the duty ratio of the display based on the image content parameter (620), and modifying the duty ratio based on an updated image content parameter (630). In some examples, a display may show relatively bright images using a first value of duty ratio and relatively dark images using a second value of duty ratio, and the second value may be less than the first value. For example, the second value may be between approximately 0.2 and approximately 0.8 of the first value, such as between approximately 0.3 (30%) and approximately 0.6 (60%), of the second value. The method may further include displaying subsequent images (e.g., the frames of a video) using different duty ratios based on the corresponding image content parameter for the subsequent images.

FIG. 6B is a flow diagram of a computer-implemented method 650 for adjusting the duty ratio based on image content, according to some embodiments. The computer-implemented method 650 may include determining an image content parameter for a first portion of a displayed image (660), determining an image content parameter for a second portion of a displayed image (670), and adjusting the duty ratio of the first and second portions of the displayed image to different values based on the image content parameter for the respective portion (680). The image content parameter may be determined at intervals, or otherwise as a function of time, and changes in the image content parameter then result in an associated change in duty ratio.

An example method may include adjusting the duty ratio for at least a portion of the image, based on the image content parameter for the at least a portion of the image.

FIG. 7 shows an exemplary display system 720. Display system 720 may include head-mounted-display device 700 communicatively coupled to a computing device 726. Additionally or alternatively, display system 720 may include any other suitable type of display device without limitation (e.g., a television, a computer monitor, a laptop monitor, a tablet device, a portable device, such as a smartphone or cellular telephone, a wrist-watch device, a pendant device or other wearable or miniature device, a media player, a camera viewfinder, a gaming device, a navigation device, and/or any other type of device including an electronic display, without limitation). At least a portion of computing device 726 may be incorporated within a head-mounted-display system. Additionally or alternatively, at least a portion of computing device 726 may represent at least one external computing device that is in communication with head-mounted-display device 700, such as, for example, a gaming and/or multimedia console or device, a desktop, a laptop, a tablet, a cellular phone, a smart phone, a wearable device, an embedded system, an internet router, another head-mounted-display device, a hand-held controller, etc.

Head-mounted-display device 700 may include display 718 having a left-eye display region 722A and a right-eye display region 722B. (In other examples, separate displays may be used for the left and right eyes of a user.) Left-eye display region 722A and right-eye display region 722B may include portions of display 718 that are visible to a user wearing head-mounted-display device 700 via left-eye optics and right-eye optics, respectively. Each of left-eye display region 722A and right-eye display region 722B may include a plurality of pixels and subpixels that form visible images according to any suitable display technology. For example, display 718 may include any suitable type of LCD screen, such as a backlit LCD screen that modulates emitted light through an active matrix liquid crystal pixel array. In some embodiments, display system 720 may include any other suitable type of display, such as, for example, an organic light-emitting device (OLED) display (e.g., an active-matrix OLED display), a plasma display, and/or any other suitable image display.

Head-mounted-display device 700 of display system 720 may include a display driver 724 configured to drive the display 718. Display driver 724 may include any suitable circuitry for driving display 718. For example, display driver 724 may include at least one display driver integrated circuit (DDIC). In some examples, display driver 724 may include timing controller (TCON) circuitry that receives commands and/or imaging data and generates horizontal and vertical timing signals for thin-film-transistors (TFTs) of a TFT array of display 718, or other display switching components. Display driver 724 may, for example, be mounted on an edge of a TFT substrate of display 718 and electrically connected to scan lines and data lines of a TFT subpixel array.

Computing device 726 of display system 720 may communicate with display driver 724 of head-mounted-display device 702. For example, computing device 726 may send image data (video data, still image data, etc.) to display driver 724. Image data may be used by display driver 724 to generate signals that are transmitted to left-eye display region 722A and right-eye display region 722B to generate corresponding images in left-eye display region 722A and right-eye display region 722B. Computing device 726 may communicate with display driver 724 via any suitable wired and/or a wireless connection (e.g., WiFi communications, BLUETOOTH communications, cellular communications, mobile satellite communications, etc.).

Computing device 726 may also include a graphics processing unit (GPU) 728 and image data 730. In some examples, GPU 728 (and/or other system component, such as another processor) may process, analyze, and/or manipulate image data 730 that is stored on computing device 726 prior to sending image data to display driver 724 of head-mounted-display device 702. For example, GPU 728 (and/or other system component) may analyze image data 730 stored on computing device 726 to generate an image content parameter (734) and display drive data (732, such as a duty ratio of the display drive signal and/or a display backlight), that may be used to modify a displayed image or portion of an image.

In the example of FIG. 7, the controller may include display driver 724, and optionally may include the computing device 726. In some examples, the image content parameter may be determined by display driver 724.

An example display (e.g., of a head-mounted device) may include left-eye and right-eye display regions. In some examples, a display may be either a left-eye or right-eye display, or may be a display viewed by both eyes.

In some examples, the display driver may be a component of a computing device, which may further include one or more processors. Determination of the image content parameter may be performed by the controller, for example, by a display driver and/or by a computing device.

The determination of the image content parameter may be performed by the controller, and the controller may include a display driver and a separate or integrated processor configured to determine the image content parameter. In some examples, a copy of the video signal may be provided to a separate processor to determine the image content parameter, and the image content parameter may then be provided to a display driver. The controller may include a display driver and/or a computing device, such as examples described above in relation to FIG. 7.

In some examples, the duty ratio may take any value between a maximum duty ratio and a minimum duty ratio (inclusive). The duty ratio may be limited to a finite number of values between the maximum and minimum values, or may take any intermediate value. The maximum duty ratio may be approximately 10%, or any other suitable value, such as approximately 15%, approximately 20%, or approximately 30%. The minimum duty ratio may be approximately one of the following values: 1%, 2%, 3%, 4%, 5%, 6%, 7%, 8%, any intermediate value, or any other suitable value.

Method steps, such as those described above in relation to FIGS. 6A or 6B, may be performed by any suitable computer-executable code and/or computing system, including systems described herein. Methods may be performed by a circuit, such as a controller, including one or more hardware processors. In some examples, a system may include at least one physical processor, and physical memory including computer-executable instructions that, when executed by the physical processor, cause the physical processor to adjust the duty ratio of an image or a portion of an image using an image content parameter for the respective image or the portion of the image. A non-transitory computer-readable medium may include one or more computer-executable instructions that, when executed by at least one processor of a computing device, perform one or more method steps such as those discussed above.

In some examples, an image content parameter, which may include a luminance parameter such as maximum luminance, may be determined or estimated, and/or a duty ratio may be selected, based on the identity of the application being used and/or the settings associated with the application. For example, the average display luminance while using an application (such as a web browser) set to use a white background may be greater than if the application is set to use a black or otherwise dark background. The duty ratio may be correspondingly increased.

A predetermined duty ratio data may be associated with an application (e.g., for one or more settings of the application) and used for image display during use of the application. In some examples, changing the settings of an application may result in changes in the duty ratio used to display images from the application. For example, the maximum luminance may be estimated (or predetermined) for a particular game or a scene within a game. For example, the duty ratio may be reduced based on a lower luminance estimation and may be used, for example, for a night scene or underground scene.

In some examples, a duty ratio may be adjusted on a frame-by-frame basis, or for groups of frames. In some examples, the duty ratio may be adjusted based on an image content parameter for a group of image frames or based on a rolling average of the image content parameter (e.g., for a group of frames or a portion of a frame, such as a group of rows). In some examples, a duty ratio may be adjusted on a row-by-row basis, for a group of rows, or for any portion of the image.

The image display may use a gamma parameter associated with one or more of the duty ratios used to display the image. In some examples, portions of the image using different duty ratios may use different gamma parameters associated with the respective duty ratio used to display the portion of the image. The gamma parameter may be dynamically adjusted, based on dynamic adjustment of the duty ratio. In some examples, different gamma curve data may be associated with different duty ratios and stored in a memory accessible by the controller or a controller component, such as a display driver.

In some examples, a device may include a display (such as an emissive display) and a controller, and the controller may be configured to adjust the duty ratio of at least a portion of the display based on the image content of an image shown by the at least a portion of the display. The term "display" may refer to an electronic display, such as an emissive electronic display (also referred to as an emissive display). The image shown by the at least a portion of the display may be at least a portion of the image shown by the display. In some examples, a display may be driven with a lower duty ratio or a lower range of duty ratios to reduce power consumption. In some examples, the duty ratio (or limits of a duty ratio range) may be adjusted based on one or more other parameters, such as ambient light level, a component temperature, battery level, or user preference.

In some examples, the duty ratio of a display may be reduced or increased based on one or more luminance parameters of the displayed image. In some examples, the duty ratio of a portion of the display may be reduced or increased based on the luminance properties of a corresponding display portion. For example, the duty ratio may be reduced for relatively dark images, for example, images with a relatively low value of peak luminance, and/or a relatively low value of average luminance (such as mean luminance, median luminance, or other suitable average luminance). In some examples, a portion of the displayed image may include one or more rows of the displayed image.

In some examples, a first part of the display may include a first plurality of display rows, and a second part of the display may include a second plurality of display rows. The duty ratio used for each portion of a displayed image, shown on corresponding parts of the display, may be different. The duty ratio for each portion of the image may be based, for example, on the different image content parameters for the corresponding portions of the image.

In some examples, a controller may be configured to determine the image content, and adjust the duty ratio of the display. In some examples, a controller may include a display driver integrated circuit (DDIC), that may be configured to determine one or more image content parameters (such as luminance properties) and adjust the duty ratio of the display, or a portion thereof, based on the one or more image content parameters. In some examples, one or both of an AP (application processor) and/or a DDIC (or other video processor) may execute an algorithm for image content parameter estimation, for example, using a histogram analysis.

In some examples, the image content parameter may be determined by analysis of the display signal, that may be or include the signal provided by the controller to the display, and/or the signal received by the controller (e.g., from a video signal source). In some examples, the image content parameter may be determined from a luminance component of the display signal. In some examples, the analysis may include a histogram analysis of the brightness of the display or a portion thereof.

In some examples, a DDIC, or other controller component, may be configured to perform an analysis of an image, or portion thereof, to determine an image content parameter and vary the duty ratio in accordance with the determined duty ratio. A corresponding gamma curve may be adjusted based on the duty ratio used. Different gamma curves may be determined for each duty ratio (or for different values of duty ratios, such as different ranges of duty ratios) may be stored in an associated memory or within the DDIC. The DDIC may be configured to determine an image content parameter, adjust the duty ratio to a value based on the image content parameter, and select a gamma curve based on the value of the duty ratio.

In some examples, an image content parameter based on brightness may be determined by summing (or averaging) the brightness of all pixels (e.g., all colors, such as RGB) for the image, or a portion of the image. In some examples, the determination of brightness (or luminance) may be weighted by other factors, such as one or more of: the eye response (e.g., the photopic luminosity function); ambient light brightness (e.g., for augmented reality applications); ambient light spectral distribution; or user preferences (e.g., through a preferred color balance parameter).

In some examples, different gamma curves may be associated with different duty ratios, and the relevant data stored in memory. As the duty ratio is adjusted, a different gamma curve may be used to drive the display. In this context, a gamma curve may relate pixel intensity (that may also be termed brightness in some examples) to the value of a brightness signal, and may be non-linear.

In some examples, a rolling mode may be used for duty ratio control of the display. Content-based persistent control based on duty ratio may be implemented using one or more of various approaches. In some examples, image content parameters are determined using horizontal slices, or row-by-row of a displayed image, or using any appropriate image sampling approach, for example, to reduce the latency for content analysis.

In some examples, the image content parameter may be determined for a particular time period, such as for a single frame time or portion thereof, a row time, or an integer multiple of row times. In some examples, the image content parameter may be determined for a one or a multiple of the frame time, such as a time period equivalent to 1-1,000 frame times (e.g., as an average, such as a mean or median). In some examples, the image content parameter may be determined for particular time period, such as one second, or integer multiples or fractions thereof, such as a time period of between approximately 1 ms and approximately 10 second. The duty ratio may be adjusted to a particular value for the same time period, and then may be adjusted for a following time period. The adjustments in the duty ratio may be in effectively real time as the image content parameter is determined, or may lag determination of the image content parameter, for example, by a time period based on that used to determine the image content parameter. In some examples, the image content parameter may be determined at intervals, and the duty ratio may be adjusted to a particular value, for example, for the duration of an intervening time between successive image content parameter determinations.

A slice-by-slice or row-by-row method may also improve the persistence reduction of the display, even for images in which certain row(s) or slice(s) have high light intensity (e.g., high brightness) pixels. In some examples, a device includes a display, a controller, and an optical system configured to form a virtual image or an augmented reality image element using light from the display. The controller may include a display driver, such as a display driver integrated circuit (DDIC). The DDIC may be in electrical communication with the display, and in some examples may be a component of a display assembly that includes the display. In some examples, the controller may also include a multiplexer, for example, for multiplexed driving of active matrix elements or other display components. In some examples, the controller may include one or more of a display driver, a video processor, or an application processor.

In some examples, a computing device may be configured to determine a first image content parameter for a first image or a first portion of an image, determine a second image content parameter for a second image or a second portion of an image, display the first image or the first portion of the image portion using a duty ratio based on the first image content parameter, and display the second image or the second portion of an image using the second image content parameter. A device may include a display and a controller, and the controller may be configured to adjust the duty ratio of the display based on an image content parameter related to a displayed image. The image content parameter may be based on at least one of: maximum luminance, mean luminance, median luminance, a predetermined percentile of any other luminance parameter (such as maximum luminance). In some examples, the image content parameter may be based on minimum luminance, or a predetermined multiple of minimum luminance. The image content parameter may be based on any suitable luminance-related parameter, such as display brightness, or an intensity of one or more pixels.

The controller may include a DDIC, and may be configured to adjust the duty ratio of a portion of the displayed image based on the image content parameter for the portion of the displayed image. The portion of the displayed image may include at least one row of the displayed image. The controller may be configured to determine the image content parameter using a histogram analysis of a display control signal. The duty ratio for a displayed image may have a spatial variation based on a spatial variation of the image content parameter. For example, the duty ratio may vary as a function of row number. The controller may be configured to drive a display using an addressing scheme. Example addressing schemes may include passive-matrix addressing or active-matrix addressing. An active matrix display may include an arrangement of thin-film transistors on one or both substrates of the display.

The display may be an emissive display, such as a light-emitting display such as an OLED (organic light-emitting display). In some examples, the display may be a micro-display, such as a micro-emissive display, such as a micro-OLED display. A micro-display may have a diagonal dimension of less than 25 mm, such as less than 20 mm. In some examples, the duty ratio of an emissive display, such as a micro-OLED display, may be dynamically adjusted based on an image content parameter, such as the maximum luminance of the image. The image content parameter may be determined for an image frame, a group of image frames, or a portion of an image frame, such as one or more rows. The duty ratio may be reduced for relatively dark scenes, allowing reduced motion blur. Other advantages may include reduced voltage operation, reduced power consumption, or improved display lifetime. The duty ratio may be spatially varied across the display based on the corresponding image content.

In some examples, a device, such as an augmented reality device or a virtual reality device, may include one or more displays. For example, separate displays may be provided for left and right eyes, or, in some examples, left and right portions of a single display may be used for the respective eye. A device may include an organic light-emitting device (OLED) display, such as a micro-OLED display. A display an active matrix configured to control the activation of display pixels. An active display may be supported by a substrate, such as a silicon backplane. In some examples, a device may include a display and a controller, that may include a one or more display drivers (such as display driver integrated circuits).

In some examples, a display may include a light-emitting diode (LED) display, that may include semiconductor-based and/or organic light-emitting pixels. Approaches described herein may be used with any emissive display technology (such as an emissive micro-display), for example, to reduce power consumption, and in some examples, improve device lifetime.

In some examples, a display may include a backlight, and the backlight or portions thereof may be illuminated with a duty ratio (that may be termed an illumination duty ratio, or "duty ratio" for conciseness). The backlight illumination duty ratio of at least a portion of a backlight may be adjusted based on an image content parameter for a displayed image. The displayed image may be displayed with another display technology, such as a liquid crystal display, and the intensity of the backlight may be adjusted based on one or more image content parameters. In some examples, a backlight may be dimmed based on an image content parameter (e.g., in a manner based on image luminance) for low brightness scenes. Different portions of a backlight may be energized using different duty ratios based on respective image content parameters. Approaches described herein may be used to reduce power consumption of the backlight, or to extend the lifetime of the backlight through reducing the maximum backlight drive voltages. For example, the duty ratio of a backlight or portion thereof may be reduced for the display of relatively lower brightness images. Examples may include the backlights for liquid crystal displays, for example, LCDs (liquid crystal displays) with strobe-style backlights.

In some examples, a display may include one or more light-emitting devices (sometimes referred to as light-emitting elements), such as an organic light-emitting device (OLED). An OLED display may include organic light-emitting diodes, though any emissive device configuration may be used. An example OLED may include an emissive layer located between first and second electrodes, that may be designated anode and cathode. Electrodes may be patterned, for example, to obtain a display with a plurality of pixels. An OLED may include a micro-OLED display, such as an emissive micro-display having a diagonal dimension of less than 25 mm, such as less than 20 mm.

In some examples, device performance may be improved, and/or degradation of the emissive layer may be slowed or prevented, using additional layers between the electrodes and the emissive layer, such as hole or electron transport or injection layer(s), and/or hole or electron blocking layer(s). An OLED display may include an arrangement of OLEDs, such as an array of emissive elements that may be termed pixels. An OLED display may be formed on a substrate. In some examples, the substrate may support an arrangement of transistors and associated components (e.g., capacitors) that support an active matrix addressing scheme. In some examples, a substrate may include a semiconductor substrate, such as a silicon substrate. Electrodes may include any appropriate material, that may be selected on the basis of one or more of electrical conductivity, work function, optical transparency, stability (e.g., to air oxidation or other degradation), or relative inertness with respect to interactions with adjacent layers. Example electrode materials may include one or more of the following: a transparent conductive oxide such as tin oxide or indium tin oxide (ITO), a metal, a conducting polymer, a doped semiconductor, or any other suitable material. The emissive layer may include one or more organic molecules, such as electroluminescent organic compounds. The emissive layer may also include dyes, dopants, matrix materials, or any other suitable components.

In some examples, a color display may include red, green, and blue pixels. Other color combinations may be used. Different emissive properties may result from compositional variations between the emissive layers of different light emissive pixels. In some examples, color filters may be used to provide or modify color emission from one or more pixels.

In some examples, an OLED display may be a microOLED display. A microOLED display may have a pixel dimension on the micron scale. For example, a microOLED may have in excess of 1 million pixels with a display diagonal of less than 1 inch. Embodiments of the present disclosure may be used with various display technologies, such as those described herein.

In some examples, a method of operating a display, such as an emissive display, includes determining an image content parameter for at least a portion of an image, and displaying the at least a portion of the image on the display using a first duty ratio based on the image content parameter. The method may further include displaying a second portion of the image using a second duty ratio, where the second duty ratio is different from the first duty ratio.

Embodiments of the present disclosure may include or be implemented in conjunction with various types of artificial reality systems. Artificial reality may include forms of reality that have been adjusted in some manner before presentation to a user, that may include, for example, a virtual reality, an augmented reality, a mixed reality, a hybrid reality, or some combination and/or derivative thereof. Artificial-reality content may include mostly computer-generated content, or computer-generated content combined with captured (e.g., real-world) content. The artificial-reality content (that may also be referred to more concisely as artificial reality) may include video, audio, haptic feedback, or some combination thereof, any of that may be presented in a single channel or in multiple channels (such as stereo video that produces a three-dimensional (3D) effect to the viewer). Additionally, in some embodiments, artificial reality may also be associated with applications, products, accessories, services, or some combination thereof, that are used to, for example, create content in an artificial reality and/or are otherwise used in (e.g., to perform activities in) an artificial reality.

In some examples, the duty ratio of a display, such as a micro-OLED display, may be dynamically adjusted based on an image content parameter, such as the maximum luminance of the image or an image portion. The image content parameter may be determined for an image frame, a group of image frames, or a portion of an image frame, such as one or more rows. An image frame may also be referred to more concisely as an "image", though an image may, in some examples, be displayed as a plurality of image frames. The duty ratio may be reduced for relatively dark scenes, allowing reduced motion blur. Other advantages may include reduced voltage operation, reduced power consumption, or improved display lifetime. The duty ratio may be spatially varied across the display based on the corresponding image content.

In some examples, a device may be (or include) an artificial reality device or a virtual reality device. Examples include such devices that may include a display having an adjustable duty ratio.

Example Embodiments

Example 1. A device may include a display including a plurality of pixels, and a controller configured to determine an image content parameter for a displayed image shown on the display, and adjust a duty ratio of the display based on the image content parameter.

Example 2. The device of example 1, where the image content parameter is based on a maximum brightness of the displayed image.

Example 3. The device of examples 1 or 2, where the image content parameter is based on at least one of: maximum luminance, mean luminance, median luminance, a predetermined percentile of maximum luminance, or minimum luminance.

Example 4. The device of any of examples 1-3, where the duty ratio includes a fraction of time that at least one pixel of the plurality of pixels is illuminated during a particular time period.

Example 5. The device of any of examples 1-4, where the particular time period is a row time, a frame time, an integer multiple of the row time, or an integer multiple of the frame time.

Example 6. The device of any of examples 1-5, where the controller is configured to adjust the duty ratio of a portion of the displayed image based on the image content parameter for the portion of the displayed image.

Example 7. The device of any of examples 1-6, where the portion of the displayed image includes at least one row of the displayed image.

Example 8. The device of any of examples 1-7, where the controller is configured to determine the image content parameter based on an analysis of a display control signal.

Example 9. The device of example 8, where the analysis of the display control signal includes a histogram analysis.

Example 10. The device of any of examples 1-9, where the duty ratio has a spatial variation over the display based on image content parameter variations.

Example 11. The device of any of examples 1-10, where the controller includes a display driver integrated circuit (DDIC).

Example 12. The device of any of examples 1-11, where the display is an emissive display.

Example 13. The device of any of examples 1-12, where the display includes an organic light-emitting device (OLED).

Example 14. The device of any of examples 1-13, where the device includes an augmented reality device.

Example 15. The device of any of examples 1-14, where the controller is configured to determine the image content parameter using an analysis of a display drive signal provided by the controller to the display.

Example 16. An example method may include determining an image content parameter for a portion of an image, displaying the portion of the image on part of a display using a duty ratio that is based on the image content parameter for the portion of the image, and adjusting the duty ratio based on changes in the image content parameter for the portion of the image.

Example 17. The method of example 16, further including displaying a second portion of the image on a second part of the display using a second duty ratio, where the second duty ratio is based on a second image content parameter associated with the second portion of the image, and where the duty ratio and the second duty ratio have different values.

Example 18. The method of examples 16 or 17, where the display is an emissive display having display rows, the part of the display includes a first plurality of display rows, and the second part of the display includes a second plurality of display rows.

Example 19. An example method may include determining a first image content parameter for a first image, displaying the first image on a display using a first duty ratio based on the first image content parameter, determining a second image content parameter for a second image, and displaying the second image on the display using a second duty ratio based on the second image content parameter, where the first duty ratio and second duty ratio have different values.

Example 20. The method of example 19, where the first image and the second image are frames of a video, and the display is an emissive electronic display.

Embodiments of the present disclosure may include or be implemented in conjunction with various types of artificial reality systems. Artificial reality is a form of reality that has been adjusted in some manner before presentation to a user, that may include, for example, a virtual reality, an augmented reality, a mixed reality, a hybrid reality, or some combination and/or derivative thereof. Artificial-reality content may include completely computer-generated content or computer-generated content combined with captured (e.g., real-world) content. The artificial-reality content may include video, audio, haptic feedback, or some combination thereof, any of which may be presented in a single channel or in multiple channels (such as stereo video that produces a three-dimensional (3D) effect to the viewer). Additionally, in some embodiments, artificial reality may also be associated with applications, products, accessories, services, or some combination thereof, that are used to, for example, create content in an artificial reality and/or are otherwise used in (e.g., to perform activities in) an artificial reality.

Artificial-reality systems may be implemented in a variety of different form factors and configurations. Some artificial reality systems may be designed to work without near-eye displays (NEDs). Other artificial reality systems may include an NED that also provides visibility into the real world (such as, e.g., augmented-reality system 800 in FIG. 8) or that visually immerses a user in an artificial reality (such as, e.g., virtual-reality system 900 in FIG. 9). While some artificial-reality devices may be self-contained systems, other artificial-reality devices may communicate and/or coordinate with external devices to provide an artificial-reality experience to a user. Examples of such external devices include handheld controllers, mobile devices, desktop computers, devices worn by a user, devices worn by one or more other users, and/or any other suitable external system.

Turning to FIG. 8, augmented-reality system 800 may include an eyewear device 802 with a frame 810 configured to hold a left display device 815(A) and a right display device 815(B) in front of a user's eyes. Display devices 815(A) and 815(B) may act together or independently to present an image or series of images to a user. While augmented-reality system 800 includes two displays, embodiments of this disclosure may be implemented in augmented-reality systems with a single NED or more than two NEDs.

In some embodiments, augmented-reality system 800 may include one or more sensors, such as sensor 840. Sensor 840 may generate measurement signals in response to motion of augmented-reality system 800 and may be located on substantially any portion of frame 810. Sensor 840 may represent one or more of a variety of different sensing mechanisms, such as a position sensor, an inertial measurement unit (IMU), a depth camera assembly, a structured light emitter and/or detector, or any combination thereof. In some embodiments, augmented-reality system 800 may or may not include sensor 840 or may include more than one sensor. In embodiments in which sensor 840 includes an IMU, the IMU may generate calibration data based on measurement signals from sensor 840. Examples of sensor 840 may include, without limitation, accelerometers, gyroscopes, magnetometers, other suitable types of sensors that detect motion, sensors used for error correction of the IMU, or some combination thereof.

In some examples, augmented-reality system 800 may also include a microphone array with a plurality of acoustic transducers 820(A)-820(J), referred to collectively as acoustic transducers 820. Acoustic transducers 820 may represent transducers that detect air pressure variations induced by sound waves. Each acoustic transducer 820 may be configured to detect sound and convert the detected sound into an electronic format (e.g., an analog or digital format). The microphone array in FIG. 8 may include, for example, ten acoustic transducers: 820(A) and 820(B), that may be designed to be placed inside a corresponding ear of the user, acoustic transducers 820(C), 820(D), 820(E), 820(F), 820(G), and 820(H), that may be positioned at various locations on frame 810, and/or acoustic transducers 820(I) and 820(J), that may be positioned on the neckband 805.

In some embodiments, one or more of acoustic transducers 820(A)-(J) may be used as output transducers (e.g., speakers). For example, acoustic transducers 820(A) and/or 820(B) may be earbuds or any other suitable type of headphone or speaker.

The configuration of acoustic transducers 820 of the microphone array may vary. While augmented-reality system 800 is shown in FIG. 8 as having ten acoustic transducers 820, the number of acoustic transducers 820 may be greater or less than ten. In some embodiments, using higher numbers of acoustic transducers 820 may increase the amount of audio information collected and/or the sensitivity and accuracy of the audio information. In contrast, using a lower number of acoustic transducers 820 may decrease the computing power required by an associated controller 850 to process the collected audio information. In addition, the position of each acoustic transducer 820 of the microphone array may vary. For example, the position of an acoustic transducer 820 may include a defined position on the user, a defined coordinate on frame 810, an orientation associated with each acoustic transducer 820, or some combination thereof.

Acoustic transducers 820(A) and 820(B) may be positioned on different parts of the user's ear, such as behind the pinna, behind the tragus, and/or within the auricle or fossa. Or, there may be additional acoustic transducers 820 on or surrounding the ear in addition to acoustic transducers 820 inside the ear canal. Having an acoustic transducer 820 positioned next to an ear canal of a user may enable the microphone array to collect information on how sounds arrive at the ear canal. By positioning at least two of acoustic transducers 820 on either side of a user's head (e.g., as binaural microphones), augmented-reality system 800 may simulate binaural hearing and capture a 3D stereo sound field around about a user's head. In some embodiments, acoustic transducers 820(A) and 820(B) may be connected to augmented-reality system 800 via a wired connection 830, and in other embodiments, acoustic transducers 820(A) and 820(B) may be connected to augmented-reality system 800 via a wireless connection (e.g., a Bluetooth connection). In still other embodiments, acoustic transducers 820(A) and 820(B) may not be used at all in conjunction with augmented-reality system 800.

Acoustic transducers 820 on frame 810 may be positioned in a variety of different ways, including along the length of the temples, across the bridge, above or below display devices 815(A) and 815(B), or some combination thereof. Acoustic transducers 820 may also be oriented such that the microphone array is able to detect sounds in a wide range of directions surrounding the user wearing the augmented-reality system 800. In some embodiments, an optimization process may be performed during manufacturing of augmented-reality system 800 to determine relative positioning of each acoustic transducer 820 in the microphone array.

In some examples, augmented-reality system 800 may include or be connected to an external device (e.g., a paired device), such as neckband 805. Neckband 805 generally represents any type or form of paired device. Thus, the following discussion of neckband 805 may also apply to various other paired devices, such as charging cases, smart watches, smart phones, wrist bands, other wearable devices, hand-held controllers, tablet computers, laptop computers, other external compute devices, etc.

As shown, neckband 805 may be coupled to eyewear device 802 via one or more connectors. The connectors may be wired or wireless and may include electrical and/or non-electrical (e.g., structural) components. In some cases, eyewear device 802 and neckband 805 may operate independently without any wired or wireless connection between them. While FIG. 8 illustrates the components of eyewear device 802 and neckband 805 in example locations on eyewear device 802 and neckband 805, the components may be located elsewhere and/or distributed differently on eyewear device 802 and/or neckband 805. In some embodiments, the components of eyewear device 802 and neckband 805 may be located on one or more additional peripheral devices paired with eyewear device 802, neckband 805, or some combination thereof.

Pairing external devices, such as neckband 805, with augmented-reality eyewear devices may enable the eyewear devices to achieve the form factor of a pair of glasses while still providing sufficient battery and computation power for expanded capabilities. Some or all of the battery power, computational resources, and/or additional features of augmented-reality system 800 may be provided by a paired device or shared between a paired device and an eyewear device, thus reducing the weight, heat profile, and form factor of the eyewear device overall while still retaining desired functionality. For example, neckband 805 may allow components that would otherwise be included on an eyewear device to be included in neckband 805 since users may tolerate a heavier weight load on their shoulders than they would tolerate on their heads. Neckband 805 may also have a larger surface area over which to diffuse and disperse heat to the ambient environment. Thus, neckband 805 may allow for greater battery and computation capacity than might otherwise have been possible on a stand-alone eyewear device. Since weight carried in neckband 805 may be less invasive to a user than weight carried in eyewear device 802, a user may tolerate wearing a lighter eyewear device and carrying or wearing the paired device for greater lengths of time than a user would tolerate wearing a heavy standalone eyewear device, thereby enabling users to more fully incorporate artificial reality environments into their day-to-day activities.

Neckband 805 may be communicatively coupled with eyewear device 802 and/or to other devices. These other devices may provide certain functions (e.g., tracking, localizing, depth mapping, processing, storage, etc.) to augmented-reality system 800. In the embodiment of FIG. 8, neckband 805 may include two acoustic transducers (e.g., 820(I) and 820(J)) that are part of the microphone array (or potentially form their own microphone subarray). Neckband 805 may also include a controller 825 and a power source 835.

Acoustic transducers 820(I) and 820(J) of neckband 805 may be configured to detect sound and convert the detected sound into an electronic format (analog or digital). In the embodiment of FIG. 8, acoustic transducers 820(I) and 820(J) may be positioned on neckband 805, thereby increasing the distance between the acoustic transducers 820(I) and 820(J) on neckband 805, and other acoustic transducers 820 positioned on eyewear device 802. In some cases, increasing the distance between acoustic transducers 820 of the microphone array may improve the accuracy of beamforming performed via the microphone array. For example, if a sound is detected by acoustic transducers 820(C) and 820(D) and the distance between acoustic transducers 820(C) and 820(D) is greater than, for example, the distance between acoustic transducers 820(D) and 820(E), the determined source location of the detected sound may be more accurate than if the sound had been detected by acoustic transducers 820(D) and 820(E).

Controller 825 of neckband 805 may process information generated by the sensors on neckband 805 and/or augmented-reality system 800. For example, controller 825 may process information from the microphone array that describes sounds detected by the microphone array. For each detected sound, controller 825 may perform a direction-of-arrival (DOA) estimation to estimate a direction from which the detected sound arrived at the microphone array. As the microphone array detects sounds, controller 825 may populate an audio data set with the information. In examples in which augmented-reality system 800 includes an inertial measurement unit, controller 825 may compute all inertial and spatial calculations from the IMU located on eyewear device 802. A connector may convey information between augmented-reality system 800 and neckband 805 and between augmented-reality system 800 and controller 825. The information may be in the form of optical data, electrical data, wireless data, or any other transmittable data form. Moving the processing of information generated by augmented-reality system 800 to neckband 805 may reduce weight and heat in eyewear device 802, making it more comfortable to the user.

Power source 835 in neckband 805 may provide power to eyewear device 802 and/or to neckband 805. Power source 835 may include, without limitation, lithium ion batteries, lithium-polymer batteries, primary lithium batteries, alkaline batteries, or any other form of power storage. In some cases, power source 835 may be a wired power source. Including power source 835 on neckband 805 instead of on eyewear device 802 may help better distribute the weight and heat generated by power source 835.

As noted, some artificial reality systems may, instead of blending an artificial reality with actual reality, substantially replace one or more of a user's sensory perceptions of the real world with a virtual experience. One example of this type of system is a head-worn display system, such as virtual-reality system 900 in FIG. 9, that mostly or completely covers a user's field of view. Virtual-reality system 900 may include a front rigid body 902 and a band 904 shaped to fit around a user's head. Virtual-reality system 900 may also include output audio transducers 906(A) and 906(B). Furthermore, while not shown in FIG. 9, front rigid body 902 may include one or more electronic elements, including one or more electronic displays, one or more inertial measurement units (IMUs), one or more tracking emitters or detectors, and/or any other suitable device or system for creating an artificial-reality experience.

Artificial reality systems may include a variety of types of visual feedback mechanisms. For example, display devices in augmented-reality system 800 and/or virtual-reality system 900 may include one or more liquid crystal displays (LCDs), light-emitting diode (LED) displays, organic LED (OLED) displays, digital light project (DLP) micro-displays, liquid crystal on silicon (LCoS) micro-displays, and/or any other suitable type of display screen. These artificial reality systems may include a single display screen for both eyes or may provide a display screen for each eye, that may allow for additional flexibility for varifocal adjustments or for correcting a user's refractive error. Some of these artificial reality systems may also include optical subsystems having one or more lenses (e.g., conventional concave or convex lenses, Fresnel lenses, adjustable liquid lenses, etc.) through which a user may view a display screen. These optical subsystems may serve a variety of purposes, including to collimate (e.g., make an object appear at a greater distance than its physical distance), to magnify (e.g., make an object appear larger than its actual size), and/or to relay (to, e.g., the viewer's eyes) light. These optical subsystems may be used in a non-pupil-forming architecture (such as a single lens configuration that directly collimates light but may result in so-called pincushion distortion) and/or a pupil-forming architecture (such as a multi-lens configuration that produces so-called barrel distortion to nullify pincushion distortion).

In addition to or instead of using display screens, some of the artificial reality systems described herein may include one or more projection systems. For example, display devices in augmented-reality system 800 and/or virtual-reality system 900 may include micro-LED projectors that project light (using, e.g., a waveguide) into display devices, such as clear combiner lenses that allow ambient light to pass through. The display devices may refract the projected light toward a user's pupil and may enable a user to simultaneously view both artificial-reality content and the real world. The display devices may accomplish this using any of a variety of different optical components, including waveguide components (e.g., holographic, planar, diffractive, polarized, and/or reflective waveguide elements), light-manipulation surfaces and elements (such as diffractive, reflective, and refractive elements and gratings), coupling elements, etc. Artificial reality systems may also be configured with any other suitable type or form of image projection system, such as retinal projectors used in virtual retina displays.

The artificial reality systems described herein may also include various types of computer vision components and subsystems. For example, augmented-reality system 800 and/or virtual-reality system 900 may include one or more optical sensors, such as two-dimensional (2D) or 3D cameras, structured light transmitters and detectors, time-of-flight depth sensors, single-beam or sweeping laser rangefinders, 3D LiDAR sensors, and/or any other suitable type or form of optical sensor. An artificial reality system may process data from one or more of these sensors to identify a location of a user, to map the real world, to provide a user with context about real-world surroundings, and/or to perform a variety of other functions.

The artificial reality systems described herein may also include one or more input and/or output audio transducers. Output audio transducers may include voice coil speakers, ribbon speakers, electrostatic speakers, piezoelectric speakers, bone conduction transducers, cartilage conduction transducers, tragus-vibration transducers, and/or any other suitable type or form of audio transducer. Similarly, input audio transducers may include condenser microphones, dynamic microphones, ribbon microphones, and/or any other type or form of input transducer. In some examples, a single transducer may be used for both audio input and audio output.

In some examples, the artificial reality systems described herein may also include tactile (i.e., haptic) feedback systems, that may be incorporated into headwear, gloves, body suits, handheld controllers, environmental devices (e.g., chairs, floormats, etc.), and/or any other type of device or system. Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms. Haptic feedback systems may be implemented independent of other artificial reality devices, within other artificial reality devices, and/or in conjunction with other artificial reality devices.

By providing haptic sensations, audible content, and/or visual content, artificial reality systems may create an entire virtual experience or enhance a user's real-world experience in a variety of contexts and environments. For instance, artificial reality systems may assist or extend a user's perception, memory, or cognition within a particular environment. Some systems may enhance a user's interactions with other people in the real world or may enable more immersive interactions with other people in a virtual world. Artificial reality systems may also be used for educational purposes (e.g., for teaching or training in schools, hospitals, government organizations, military organizations, business enterprises, etc.), entertainment purposes (e.g., for playing video games, listening to music, watching video content, etc.), and/or for accessibility purposes (e.g., as hearing aids, visual aids, etc.). The embodiments disclosed herein may enable or enhance a user's artificial reality experience in one or more of these contexts and environments and/or in other contexts and environments.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive data to be transformed, transform the data, output a result of the transformation to perform a function, use the result of the transformation to perform a function, and store the result of the transformation to perform a function. The function may include analysis of a video signal to determine an image content parameter relating to a displayed image. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Examples provided in this disclosure (such as example devices, device configurations, process steps, order of process steps, numerical values, or numerical ranges) are exemplary and not limiting. Range limits may be inclusive, and/or may be approximate.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A device, comprising:

a display including a plurality of pixels; and a controller configured to:

determine a first image content parameter for a first portion of a displayed image shown on the display;

determine a second image content parameter for a second portion of the displayed image shown on the display;

adjust a first duty ratio of the first portion of the display based on the first image content parameter; and adjust a second duty ratio of the second portion of the display based on the second image content parameter, wherein:

the first duty ratio is different from the second duty ratio;

the first image content parameter is based on a first brightness of the first portion of the displayed image; and the second image content parameter is based on a second brightness of the second portion of the displayed image.

2. The device of claim 1, wherein the first image content parameter is based on a maximum brightness of at least one pixel of the plurality of pixels of the displayed image.

3. The device of claim 1, wherein the first image content parameter is based on at least one of: maximum luminance, mean luminance, median luminance, a predetermined percentile of maximum luminance, or minimum luminance.

4. The device of claim 1, wherein the first duty ratio comprises a fraction of time that at least one pixel of the plurality of pixels is illuminated during a particular time period.

5. The device of claim 4, wherein the particular time period is a row time, a frame time, an integer multiple of the row time, or an integer multiple of the frame time.

6. The device of claim 1 wherein the first portion of the displayed image includes at least one row of the displayed image.

7. The device of claim 1, wherein the controller is configured to determine the first image content parameter based on an analysis of a display control signal.

8. The device of claim 7, wherein the analysis of the display control signal includes a histogram analysis.

9. The device of claim 1, wherein the controller includes a display driver integrated circuit (DDIC).

10. The device of claim 1, wherein the display is an emissive display.

11. The device of claim 1, wherein the display is an organic light-emitting device (OLED) display.

12. The device of claim 1, wherein the device comprises an augmented reality device.

13. The device of claim 1, wherein the controller is configured to determine the first image content parameter using an analysis of a display drive signal provided by the controller to the display.

14. A method, comprising:

determining first image content parameter for a first portion of an image, wherein the image is displayed on an electronic display;

determine a second image content parameter for a second portion of the image;

adjust a first duty ratio of the first portion of the image based on the first image content parameter; and adjust a second duty ratio of the second portion of the image based on the second image content parameter, wherein:

the first duty ratio is different from the second duty ratio;

the first image content parameter is based on a first brightness of the first portion of the image;

the second image content parameter is based on a second brightness of the second portion of the image; and the first duty ratio is adjusted based on changes in the first brightness of the first portion of the image.

15. The method of claim 14, further including:

adjusting the second duty ratio based on changes in the second brightness of the second portion of the image.

16. The method of claim 15, wherein:

the electronic display is an emissive display having display rows;

the first portion of the image is displayed on a first plurality of display rows; and the second portion of the image is displayed on a second plurality of display rows.

17. A method, comprising:

determining a first image content parameter for a first image portion;

displaying the first image portion on a display using a first duty ratio based on the first image content parameter;

determining a second image content parameter for a second image portion; and displaying the second image portion on the display using a second duty ratio based on the second image content parameter, wherein:

the first duty ratio and second duty ratio have different values;

the first image content parameter is based on a first brightness of the first image portion; and the second image content parameter is based on a second brightness of the second image portion.

18. The method of claim 17, wherein the first image portion and the second image portion are different portions of frames of a video, and the first image portion and second image portion are displayed on an emissive electronic display.

* * * * *